US009939195B2

(12) United States Patent
Johnke et al.

(10) Patent No.: US 9,939,195 B2
(45) Date of Patent: Apr. 10, 2018

(54) HYDROCARBON GAS PROCESSING INCLUDING A SINGLE EQUIPMENT ITEM PROCESSING ASSEMBLY

(75) Inventors: Andrew F. Johnke, Beresford, SD (US); W. Larry Lewis, Houston, TX (US); John D. Wilkinson, Midland, TX (US); Joe T. Lynch, Midland, TX (US); Hank M. Hudson, Midland, TX (US); Kyle T. Cuellar, Katy, TX (US)

(73) Assignees: Ortloff Engineers, Ltd., Midland, TX (US); S.M.E. Products LLP, Houston, TX (US)

( * ) Notice: Subject to any disclaimer, the term of this patent is extended or adjusted under 35 U.S.C. 154(b) by 1249 days.

(21) Appl. No.: 12/781,259

(22) Filed: May 17, 2010

(65) Prior Publication Data

US 2010/0287984 A1 Nov. 18, 2010

Related U.S. Application Data

(63) Continuation-in-part of application No. 12/772,472, filed on May 3, 2010, which is a continuation-in-part (Continued)

(51) Int. Cl.
*F25J 3/02* (2006.01)

(52) U.S. Cl.
CPC ..... *F25J 3/0209* (2013.01); *F25J 3/0219* (2013.01); *F25J 3/0233* (2013.01); *F25J 3/0238* (2013.01);

(Continued)

(58) Field of Classification Search
CPC ..... F25J 3/0209; F25J 3/0233; F25J 3/0238

(Continued)

(56) References Cited

U.S. PATENT DOCUMENTS 33,408 A 10/1861 Turner et al. ..... 68/22 R
3,292,380 A 12/1966 Bucklin ..... 62/621

(Continued)

OTHER PUBLICATIONS

International Search Report and Written Opinion issued in International Application No. PCT/US2011/028872 dated May 18, 2011—6 pages.

(Continued)

*Primary Examiner* — John F Pettitt
(74) *Attorney, Agent, or Firm* — Fitzpatrick, Cella, Harper & Scinto

(57) ABSTRACT

A process and an apparatus are disclosed for a compact processing assembly to recover ethane, ethylene, and heavier hydrocarbon components from a hydrocarbon gas stream. The gas stream is cooled and divided into first and second streams. The first stream is further cooled, expanded to lower pressure, and supplied as a feed between two absorbing means. The second stream is expanded to lower pressure and supplied as a bottom feed to the lower absorbing means. A distillation liquid stream from the bottom of the lower absorbing means is heated in a heat and mass transfer means to strip out its volatile components. A distillation vapor stream from the top of the heat and mass transfer means is cooled by a distillation vapor stream from the top of the upper absorbing means, thereby forming a condensed stream that is supplied as a top feed to the upper absorbing means.

37 Claims, 9 Drawing Sheets

Figure 1:
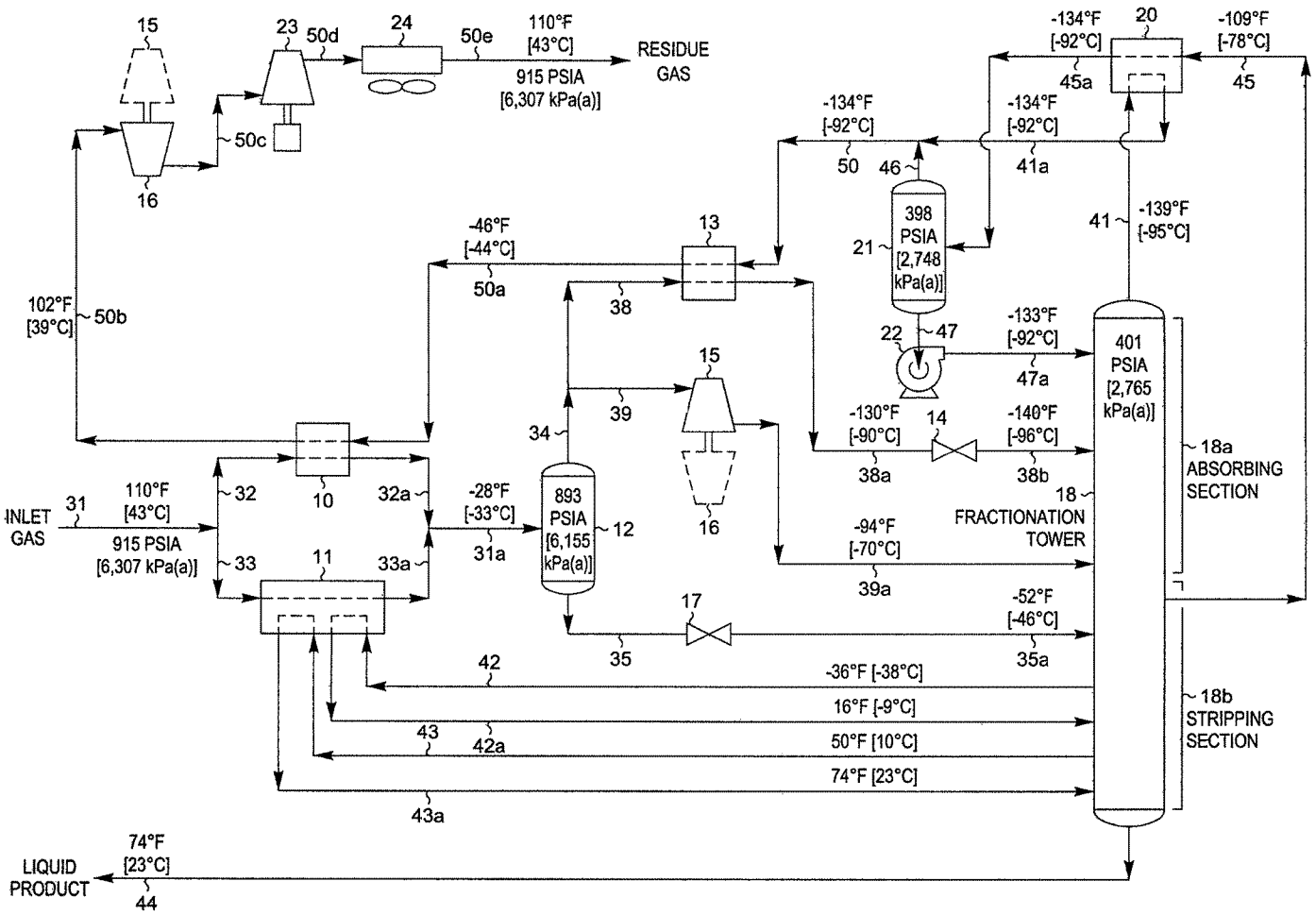
FIG. 1 (PRIOR ART)

Related U.S. Application Data of application No. 12/750,862, filed on Mar. 31, 2010, now Pat. No. 8,881,549, which is a continuation-in-part of application No. 12/717,394, filed on Mar. 4, 2010, now Pat. No. 9,080,811, which is a continuation-in-part of application No. 12/689,616, filed on Jan. 19, 2010, now Pat. No. 9,021,831, which is a continuation-in-part of application No. 12/372,604, filed on Feb. 17, 2009, now abandoned.

(60) Provisional application No. 61/186,361, filed on Jun. 11, 2009.

(52) U.S. Cl.
CPC ..... *F25J 3/0295* (2013.01); *F25J 2200/02* (2013.01); *F25J 2200/30* (2013.01); *F25J 2200/78* (2013.01); *F25J 2200/80* (2013.01); *F25J 2205/04* (2013.01); *F25J 2210/12* (2013.01); *F25J 2240/02* (2013.01); *F25J 2270/12* (2013.01); *F25J 2270/60* (2013.01); *F25J 2290/40* (2013.01)

(58) Field of Classification Search
USPC ..... 62/618, 619, 620, 621
See application file for complete search history.

(56) References Cited

U.S. PATENT DOCUMENTS

| | | | | |
|---|---|---|---|---|
| 3,477,915 | A | 11/1969 | Grant et al. | |
| 3,508,412 | A | 4/1970 | Yearout | |
| 3,516,261 | A | 6/1970 | Hoffman | |
| 3,625,017 | A | 12/1971 | Hoffman | |
| 3,797,261 | A | 3/1974 | Juncker et al. | |
| 3,969,450 | A * | 7/1976 | Hengstebeck | B01D 3/166 202/158 |
| 3,983,711 | A | 10/1976 | Solomon | 62/630 |
| 4,061,481 | A | 12/1977 | Campbell et al. | 62/621 |
| 4,127,009 | A | 11/1978 | Phillips | |
| 4,140,504 | A | 2/1979 | Campbell et al. | 62/621 |
| 4,157,904 | A | 6/1979 | Campbell et al. | 62/623 |
| 4,171,964 | A | 10/1979 | Campbell et al. | 62/621 |
| 4,185,978 | A | 1/1980 | McGalliard et al. | 62/634 |
| 4,251,249 | A | 2/1981 | Gulsby | 62/621 |
| 4,278,457 | A | 7/1981 | Campbell et al. | 62/621 |
| 4,519,824 | A | 5/1985 | Huebel | 62/621 |
| 4,617,039 | A | 10/1986 | Buck | 62/621 |
| 4,687,499 | A | 8/1987 | Aghili | 62/621 |
| 4,688,399 | A | 8/1987 | Reimann | |
| 4,689,063 | A | 8/1987 | Paradowski et al. | 62/621 |
| 4,690,702 | A | 9/1987 | Paradowski et al. | 62/621 |
| 4,854,955 | A | 8/1989 | Campbell et al. | 62/621 |
| 4,869,740 | A | 9/1989 | Campbell et al. | 62/621 |
| 4,889,545 | A | 12/1989 | Campbell et al. | 62/621 |
| 5,255,528 | A | 10/1993 | Dao | |
| 5,275,005 | A | 1/1994 | Campbell et al. | 62/621 |
| 5,282,507 | A | 2/1994 | Tongu et al. | |
| 5,316,628 | A | 5/1994 | Collin et al. | |
| 5,335,504 | A | 8/1994 | Durr et al. | 62/632 |
| 5,339,654 | A | 8/1994 | Cook et al. | |
| 5,367,884 | A | 11/1994 | Phillips et al. | |
| 5,410,885 | A | 5/1995 | Smolarek et al. | |
| 5,555,748 | A | 9/1996 | Campbell et al. | 62/621 |
| 5,566,554 | A | 10/1996 | Vijayaraghavan et al. | 62/621 |
| 5,568,737 | A | 10/1996 | Campbell et al. | 62/621 |
| 5,675,054 | A | 10/1997 | Manley et al. | |
| 5,685,170 | A | 11/1997 | Sorensen | |
| 5,713,216 | A | 2/1998 | Erickson | |
| 5,771,712 | A | 6/1998 | Campbell et al. | 62/621 |
| 5,799,507 | A | 9/1998 | Wilkinson et al. | 62/621 |
| 5,881,569 | A | 3/1999 | Campbell et al. | 62/621 |
| 5,890,377 | A | 4/1999 | Foglietta | |
| 5,890,378 | A | 4/1999 | Rambo et al. | 62/621 |
| 5,942,164 | A | 8/1999 | Tran | |
| 5,983,664 | A | 11/1999 | Campbell et al. | 62/621 |
| 6,182,469 | B1 | 2/2001 | Campbell et al. | 62/621 |
| 6,361,582 | B1 | 3/2002 | Pinnau et al. | |
| 6,516,631 | B1 | 2/2003 | Trebble | 62/630 |
| 6,565,626 | B1 | 5/2003 | Baker et al. | |
| 6,578,379 | B2 | 6/2003 | Paradowski | 62/622 |
| 6,694,775 | B1 | 2/2004 | Higginbotham et al. | |
| 6,712,880 | B2 | 3/2004 | Foglietta et al. | 95/184 |
| 6,915,662 | B2 | 7/2005 | Wilkinson et al. | 62/621 |
| 7,165,423 | B2 | 1/2007 | Winningham | 62/620 |
| 7,191,617 | B2 | 3/2007 | Cuellar et al. | 62/628 |
| 7,210,311 | B2 | 5/2007 | Wilkinson et al. | 62/611 |
| 7,219,513 | B1 | 5/2007 | Mostafa | 62/620 |
| 2002/0166336 | A1 | 11/2002 | Wilkinson et al. | |
| 2004/0079107 | A1 | 4/2004 | Wilkinson et al. | |
| 2004/0172967 | A1 | 9/2004 | Patel et al. | |
| 2005/0229634 | A1 | 10/2005 | Huebel et al. | |
| 2005/0247078 | A1 | 11/2005 | Wilkinson et al. | |
| 2005/0268649 | A1 | 12/2005 | Wilkinson et al. | 62/613 |
| 2006/0032269 | A1 | 2/2006 | Cuellar et al. | 62/620 |
| 2006/0086139 | A1 | 4/2006 | Eaton et al. | |
| 2006/0283207 | A1 | 12/2006 | Pitman et al. | 62/620 |
| 2008/0000265 | A1 | 1/2008 | Cuellar et al. | 62/630 |
| 2008/0078205 | A1 | 4/2008 | Cuellar et al. | 62/620 |
| 2008/0190136 | A1 | 8/2008 | Pitman et al. | 62/620 |
| 2008/0271480 | A1 | 11/2008 | Mak | 62/626 |
| 2009/0100862 | A1 | 4/2009 | Wilkinson et al. | 62/620 |
| 2009/0107175 | A1 | 4/2009 | Patel et al. | 62/620 |
| 2010/0236285 | A1 | 9/2010 | Johnke et al. | 62/620 |
| 2010/0251764 | A1 | 10/2010 | Johnke et al. | 62/620 |
| 2010/0275647 | A1 | 11/2010 | Johnke et al. | 62/620 |
| 2010/0287983 | A1 | 11/2010 | Johnke et al. | 62/620 |
| 2010/0326134 | A1 | 12/2010 | Johnke et al. | 62/620 |
| 2011/0226011 | A1 | 9/2011 | Johnke et al. | |
| 2011/0226012 | A1 | 9/2011 | Johnke et al. | |
| 2011/0226013 | A1 | 9/2011 | Johnke et al. | |
| 2011/0226014 | A1 | 9/2011 | Johnke et al. | |
| 2011/0232328 | A1 | 9/2011 | Johnke et al. | |

OTHER PUBLICATIONS

International Search Report and Written Opinion issued in International Application No. PCT/US2011/29234 dated May 20, 2011—29 pages.

International Search Report and Written Opinion issued in International Application No. PCT/US2011/029034 dated Jul. 27, 2011—39 pages.

International Search Report and Written Opinion issued in International Application No. PCT/US2011/029409 dated May 17, 2011—14 pages.

International Search Report and Written Opinion issued in International Application No. PCT/US2011/029239 dated May 20, 2011—20 pages.

"Dew Point Control Gas Conditioning Units," SME Products Brochure, Gas Processors Assoc. Conference (Apr. 5, 2009).

"Fuel Gas Conditioning Units for Compressor Engines," SME Products Brochure, Gas Processors Assoc. Conference (Apr. 5, 2009).

"P&ID Fuel Gas Conditioner," Drawing No. SMEP-901, Date Drawn: Aug. 29, 2007, SME, available at http://www.sme-llc.com/sme.cfm?a=prd&catID=58&subID=44&prdID=155 (Apr. 24, 2009).

"Fuel Gas Conditioner Preliminary Arrangement," Drawing No. SMP-1007-00, Date Drawn: Nov. 11, 2008, SME, available at http://www.sme-llc.com/sme.cfm?a=prd&catID=58&subID=44&prdID=155 (Apr. 24, 2009).

"Product: Fuel Gas Conditioning Units," SME Associates, LLC, available at http://www.sme-llc.com/sme.cfm?a=prd&catID=58&subID=44&prdID=155 (Apr. 24, 2009).

Mowrey, E. Ross., "Efficient, High Recovery of Liquids from Natural Gas Utilizing a High Pressure Absorber," Proceedings of the Eighty-First Annual Convention of the Gas Processors Association, Dallas, Texas, Mar. 11-13, 2002—10 pages.

(56) References Cited

OTHER PUBLICATIONS

Supplemental Notice of Allowability issued in U.S. Appl. No. 12/689,616, dated Feb. 10, 2015 (12 pages).
Comments on Statement of Reasons for Allowance filed in U.S. Appl. No. 12/689,616, dated Mar. 3, 2015 (7 pages).
Response and Statement of Interview filed in U.S. Appl. No. 13/052,575, dated Mar. 16, 2015 (37 pages).
Response and Statement of Interview filed in U.S. Appl. No. 13/052,348, dated Mar. 17, 2015 (37 pages).
Response and Statement of Interview filed in U.S. Appl. No. 13/053,792, dated Mar. 18, 2015 (37 pages).
Response, Statement of Interview and Petition for Extension of Time filed in U.S. Appl. No. 13/051,682, dated Mar. 19, 2015 (37 pages).
Response, Statement of Interview and Petition for Extension of Time filed in U.S. Appl. No. 13/048,315, dated Mar. 20, 2015 (93 pages).
Amendment and Statement of Interview filed in U.S. Appl. No. 13/052,348, dated Mar. 26, 2015 (23 pages).
Amendment and Statement of Interview filed in U.S. Appl. No. 13/051,682, dated Mar. 26, 2015 (29 pages).
Amendment and Statement of Interview filed in U.S. Appl. No. 13/053,792, dated Mar. 26, 2015 (25 pages).
Amendment and Statement of Interview filed in U.S. Appl. No. 13/052,575, dated Mar. 26, 2015 (20 pages).
Notice of Allowance and Fee(s) Due issued in U.S. Appl. No. 12/689,616, dated Jan. 9, 2015 (15 pages).
Comments on Statement of Reasons for Allowance filed in U.S. Appl. No. 12/689,616, dated Jan. 30, 2015 (8 pages).
Office Action issued in U.S. Appl. No. 13/052,348, dated Dec. 17, 2014 (13 pages).
Office Action issued in U.S. Appl. No. 13/051,682, dated Dec. 18, 2014 (13 pages).
Office Action issued in U.S. Appl. No. 13/053,792, dated Dec. 18, 2014 (20 pages).
Office Action issued in U.S. Appl. No. 13/052,575, dated Dec. 16, 2014 (16 pages).
Advisory Action Before the Filing of an Appeal Brief issued in U.S. Appl. No. 12/689,616, dated Nov. 28, 2014 (3 pages).
Submission Under 37 C.F.R. § 1.114, Statement of Interview, and Petition for Extension of Time filed in U.S. Appl. No. 12/689,616, dated Dec. 8, 2014 (39 pages).
Applicant-Initiated Interview Summary issued in U.S. Appl. No. 13/052,348, dated Feb. 20, 2015 (4 pages).
Applicant-Initiated Interview Summary issued in U.S. Appl. No. 13/053,792, dated Mar. 6, 2015 (4 pages).
Amendment, Statement of Interview and Petition for Extension of Time filed in U.S. Appl. No. 12/689,616, dated Nov. 6, 2014 (30 pages).

* cited by examiner

HYDROCARBON GAS PROCESSING INCLUDING A SINGLE EQUIPMENT ITEM PROCESSING ASSEMBLY

This invention relates to a process and apparatus for the separation of a gas containing hydrocarbons. The applicants claim the benefits under Title 35, United States Code, Section 119(e) of prior U.S. Provisional Application No. 61/186,361 which was filed on Jun. 11, 2009. The applicants also claim the benefits under Title 35, United States Code, Section 120 as a continuation-in-part of U.S. patent application Ser. No. 12/772,472 which was filed on May 3, 2010, and as a continuation-in-part of U.S. patent application Ser. No. 12/750,862 which was filed on Mar. 31, 2010, and as a continuation-in-part of U.S. patent application Ser. No. 12/717,394 which was filed on Mar. 4, 2010, and as a continuation-in-part of U.S. patent application Ser. No. 12/689,616 which was filed on Jan. 19, 2010, and as a continuation-in-part of U.S. patent application Ser. No. 12/372,604 which was filed on Feb. 17, 2009. Assignees S.M.E. Products LP and Ortloff Engineers, Ltd. were parties to a joint research agreement that was in effect before the invention of this application was made.

BACKGROUND OF THE INVENTION

Ethylene, ethane, propylene, propane, and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas also contains relatively lesser amounts of heavier hydrocarbons such as propane, butanes, pentanes, and the like, as well as hydrogen, nitrogen, carbon dioxide, and other gases.

The present invention is generally concerned with the recovery of ethylene, ethane, propylene, propane, and heavier hydrocarbons from such gas streams. A typical analysis of a gas stream to be processed in accordance with this invention would be, in approximate mole percent, 90.3% methane, 4.0% ethane and other $C_2$ components, 1.7% propane and other $C_3$ components, 0.3% iso-butane, 0.5% normal butane, and 0.8% pentanes plus, with the balance made up of nitrogen and carbon dioxide. Sulfur containing gases are also sometimes present.

The historically cyclic fluctuations in the prices of both natural gas and its natural gas liquid (NGL) constituents have at times reduced the incremental value of ethane, ethylene, propane, propylene, and heavier components as liquid products. This has resulted in a demand for processes that can provide more efficient recoveries of these products, for processes that can provide efficient recoveries with lower capital investment, and for processes that can be easily adapted or adjusted to vary the recovery of a specific component over a broad range. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,566,554; 5,568,737; 5,771,712; 5,799,507; 5,881,569; 5,890,378; 5,983,664; 6,182,469; 6,578,379; 6,712,880; 6,915,662; 7,191,617; 7,219,513; reissue U.S. Pat. No. 33,408; and co-pending application Ser. Nos. 11/430,412; 11/839,693; 11/971,491; and 12/206,230 describe relevant processes (although the description of the present invention in some cases is based on different processing conditions than those described in the cited U.S. Patents).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer or deethanizer) column. In the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product, or to separate residual methane, $C_2$ components, nitrogen, and other volatile gases as overhead vapor from the desired $C_3$ components and heavier hydrocarbon components as bottom liquid product.

If the feed gas is not totally condensed (typically it is not), the vapor remaining from the partial condensation can be split into two streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

The remaining portion of the vapor is cooled to substantial condensation by heat exchange with other process streams, e.g., the cold fractionation tower overhead. Some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will vaporize, resulting in cooling of the total stream. The flash expanded stream is then supplied as top feed to the demethanizer. Typically, the vapor portion of the flash expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components and the bottoms fraction leaving the demethanizer will contain substantially all of the heavier hydrocarbon components with essentially no methane or more volatile components. In practice, however, this ideal situation is not obtained because the conventional demethanizer is operated largely as a stripping column. The methane product of the process, therefore, typically comprises vapors leaving the top fractionation stage of the column, together with vapors not subjected to any rectification step. Considerable losses of $C_3$ and $C_4$+ components occur because the top liquid feed contains substantial quantities of these components and heavier hydrocarbon components, resulting in corresponding equilibrium quantities of $C_3$ components, $C_4$ components, and heavier hydrocarbon components in the vapors leaving the top fractionation stage of the demethanizer. The loss of these desirable components could be significantly reduced if the rising vapors could be brought into contact with a significant quantity of liquid (reflux) capable of absorbing the $C_3$ components, $C_4$ components, and heavier hydrocarbon components from the vapors.

In recent years, the preferred processes for hydrocarbon separation use an upper absorber section to provide additional rectification of the rising vapors. One method of generating a reflux stream for the upper rectification section is to use a side draw of the vapors rising in a lower portion of the tower. Because of the relatively high concentration of $C_2$ components in the vapors lower in the tower, a significant quantity of liquid can be condensed in this side draw stream without elevating its pressure, often using only the refrigeration available in the cold vapor leaving the upper rectification section. This condensed liquid, which is predominantly liquid methane and ethane, can then be used to absorb $C_3$ components, $C_4$ components, and heavier hydrocarbon components from the vapors rising through the upper rectification section and thereby capture these valuable components in the bottom liquid product from the demethanizer. U.S. Pat. No. 7,191,617 is an example of a process of this type.

The present invention employs a novel means of performing the various steps described above more efficiently and using fewer pieces of equipment. This is accomplished by combining what heretofore have been individual equipment items into a common housing, thereby reducing the plot space required for the processing plant and reducing the capital cost of the facility. Surprisingly, applicants have found that the more compact arrangement also significantly reduces the power consumption required to achieve a given recovery level, thereby increasing the process efficiency and reducing the operating cost of the facility. In addition, the more compact arrangement also eliminates much of the piping used to interconnect the individual equipment items in traditional plant designs, further reducing capital cost and also eliminating the associated flanged piping connections. Since piping flanges are a potential leak source for hydrocarbons (which are volatile organic compounds, VOCs, that contribute to greenhouse gases and may also be precursors to atmospheric ozone formation), eliminating these flanges reduces the potential for atmospheric emissions that can damage the environment.

In accordance with the present invention, it has been found that $C_3$ and $C_4$+ recoveries in excess of 99% can be obtained without the need for pumping of the reflux stream for the demethanizer with no loss in $C_2$ component recovery. The present invention provides the further advantage of being able to maintain in excess of 99% recovery of the $C_3$ and $C_4$+ components as the recovery of $C_2$ components is adjusted from high to low values. In addition, the present invention makes possible essentially 100% separation of methane (or $C_2$ components) and lighter components from the $C_2$ components (or $C_3$ components) and heavier components at lower energy requirements compared to the prior art while maintaining the same recovery level. The present invention, although applicable at lower pressures and warmer temperatures, is particularly advantageous when processing feed gases in the range of 400 to 1500 psia [2,758 to 10,342 kPa(a)] or higher under conditions requiring NGL recovery column overhead temperatures of −50° F. [−46° C.] or colder.

Figure 2:
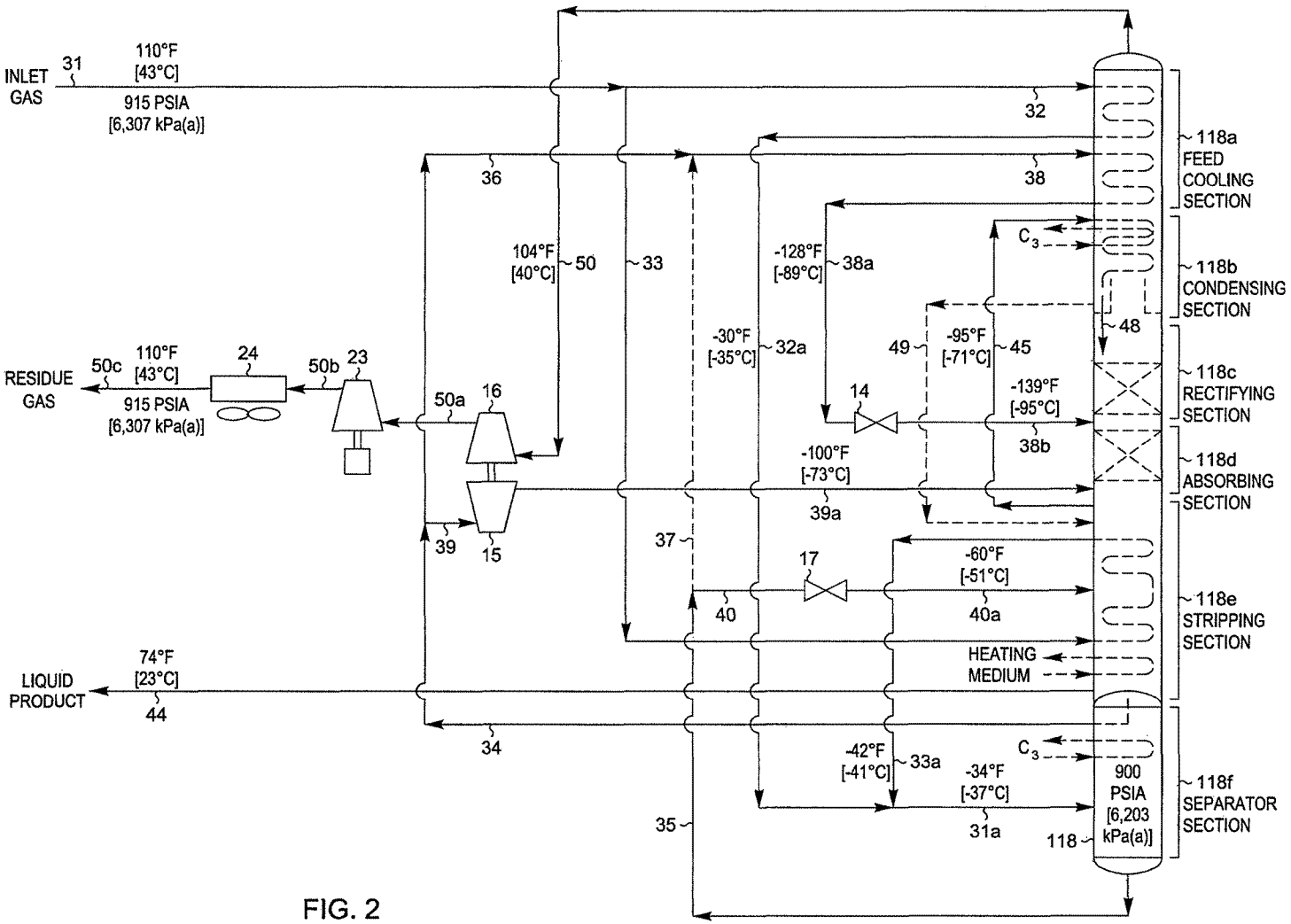

For a better understanding of the present invention, reference is made to the following examples and drawings. Referring to the drawings:

FIG. 1 is a flow diagram of a prior art natural gas processing plant in accordance with U.S. Pat. No. 7,191,617;

FIG. 2 is a flow diagram of a natural gas processing plant in accordance with the present invention; and FIGS. 3 through 9 are flow diagrams illustrating alternative means of application of the present invention to a natural gas stream.

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Systéme International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE PRIOR ART

FIG. 1 is a process flow diagram showing the design of a processing plant to recover $C_2$+ components from natural gas using prior art according to U.S. Pat. No. 7,191,617. In this simulation of the process, inlet gas enters the plant at 110° F. [43° C.] and 915 psia [6,307 kPa(a)] as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is divided into two portions, streams 32 and 33. Stream 32 is cooled to −32° F. [−36° C.] in heat exchanger 10 by heat exchange with cool residue gas stream 50*a*, while stream 33 is cooled to −18° F. [−28° C.] in heat exchanger 11 by heat exchange with demethanizer reboiler liquids at 50° F. [10° C.] (stream 43) and side reboiler liquids at −36° F. [−38° C.] (stream 42). Streams 32*a* and 33*a* recombine to form stream 31*a*, which enters separator 12 at −28° F. [−33° C.] and 893 psia [6,155 kPa(a)] where the vapor (stream 34) is separated from the condensed liquid (stream 35). The separator liquid (stream 35) is expanded to the operating pressure (approximately 401 psia [2,765 kPa (a)]) of fractionation tower 18 by expansion valve 17, cooling stream 35*a* to −52° F. [−46° C.] before it is supplied to fractionation tower 18 at a lower mid-column feed point.

The vapor (stream 34) from separator 12 is divided into two streams, 38 and 39. Stream 38, containing about 32% of the total vapor, passes through heat exchanger 13 in heat exchange relation with cold residue gas stream 50 where it is cooled to substantial condensation. The resulting substantially condensed stream 38*a* at −130° F. [−90° C.] is then flash expanded through expansion valve 14 to the operating pressure of fractionation tower 18. During expansion a portion of the stream is vaporized, resulting in cooling of the total stream. In the process illustrated in FIG. 1, the expanded stream 38*b* leaving expansion valve 14 reaches a temperature of −140° F. [−96° C.] and is supplied to fractionation tower 18 at an upper mid-column feed point.

The remaining 68% of the vapor from separator 12 (stream 39) enters a work expansion machine 15 in which mechanical energy is extracted from this portion of the high pressure feed. The machine 15 expands the vapor substantially isentropically to the tower operating pressure, with the work expansion cooling the expanded stream 39*a* to a temperature of approximately −94° F. [−70° C.]. The typical commercially available expanders are capable of recovering on the order of 80-85% of the work theoretically available in an ideal isentropic expansion. The work recovered is often used to drive a centrifugal compressor (such as item 16) that can be used to re-compress the heated residue gas stream (stream 50*b*), for example. The partially condensed expanded stream 39*a* is thereafter supplied as feed to fractionation tower 18 at a lower mid-column feed point.

The demethanizer in tower 18 is a conventional distillation column containing a plurality of vertically spaced trays, one or more packed beds, or some combination of trays and packing. As is often the case in natural gas processing plants, the demethanizer tower consists of two sections: an upper absorbing (rectification) section 18*a* that contains the trays and/or packing to provide the necessary contact between the vapor portion of expanded streams 38*b* and 39*a* rising upward and cold liquid falling downward to condense and absorb the $C_2$ components, $C_3$ components, and heavier components; and a lower stripping (demethanizing) section 18*b* that contains the trays and/or packing to provide the necessary contact between the liquids falling downward and the vapors rising upward. The demethanizing section 18*b* also includes reboilers (such as the reboiler and the side reboiler described previously) which heat and vaporize a portion of the liquids flowing down the column to provide the stripping vapors which flow up the column to strip the liquid product (stream 44) of methane and lighter components. The liquid product stream 44 exits the bottom of the tower at 74° F. [23° C.], based on a typical specification of a methane to ethane ratio of 0.010:1 on a mass basis in the bottom product.

A portion of the distillation vapor (stream 45) is withdrawn from the upper region of stripping section 18*b*. This stream is then cooled from −109° F. [−78° C.] to −134° F. [−92° C.] and partially condensed (stream 45*a*) in heat exchanger 20 by heat exchange with the cold demethanizer overhead stream 41 exiting the top of demethanizer 18 at −139° F. [−95° C.]. The cold demethanizer overhead stream is warmed slightly to −134° F. [−92° C.] (stream 41*a*) as it cools and condenses at least a portion of stream 45.

The operating pressure in reflux separator 21 (398 psia [2,748 kPa(a)]) is maintained slightly below the operating pressure of demethanizer 18. This provides the driving force which causes distillation vapor stream 45 to flow through heat exchanger 20 and thence into the reflux separator 21 wherein the condensed liquid (stream 47) is separated from any uncondensed vapor (stream 46). Stream 46 then combines with the warmed demethanizer overhead stream 41*a* from heat exchanger 20 to form cold residue gas stream 50 at −134° F. [−92° C.].

The liquid stream 47 from reflux separator 21 is pumped by pump 22 to a pressure slightly above the operating pressure of demethanizer 18, and stream 47*a* is then supplied as cold top column feed (reflux) to demethanizer 18. This cold liquid reflux absorbs and condenses the $C_3$ components and heavier components rising in the upper rectification region of absorbing section 18*a* of demethanizer 18.

The distillation vapor stream forming the tower overhead (stream 41) is warmed in heat exchanger 20 as it provides cooling to distillation stream 45 as described previously, then combines with stream 46 to form the cold residue gas stream 50. The residue gas passes countercurrently to the incoming feed gas in heat exchanger 13 where it is heated to −46° F. [−44° C.] (stream 50*a*) and in heat exchanger 10 where it is heated to 102° F. [39° C.] (stream 50*b*) as it provides cooling as previously described. The residue gas is then re-compressed in two stages. The first stage is compressor 16 driven by expansion machine 15. The second stage is compressor 23 driven by a supplemental power source which compresses the residue gas (stream 50*d*) to sales line pressure. After cooling to 110° F. [43° C.] in discharge cooler 24, residue gas stream 50*e* flows to the sales gas pipeline at 915 psia [6,307 kPa(a)], sufficient to meet line requirements (usually on the order of the inlet pressure).

A summary of stream flow rates and energy consumption for the process illustrated in FIG. 1 is set forth in the following table:

TABLE I (FIG. 1)
Stream Flow Summary - Lb. Moles/Hr [kg moles/Hr]

| Stream | Methane | Ethane | Propane | Butanes+ | Total |
|---|---|---|---|---|---|
| 31 | 12,398 | 546 | 233 | 229 | 13,726 |
| 32 | 8,431 | 371 | 159 | 156 | 9,334 |
| 33 | 3,967 | 175 | 74 | 73 | 4,392 |
| 34 | 12,195 | 501 | 179 | 77 | 13,261 |
| 35 | 203 | 45 | 54 | 152 | 465 |
| 38 | 3,963 | 163 | 58 | 25 | 4,310 |
| 39 | 8,232 | 338 | 121 | 52 | 8,951 |
| 41 | 11,687 | 74 | 2 | 0 | 11,967 |
| 45 | 936 | 34 | 2 | 0 | 1,000 |
| 46 | 702 | 8 | 0 | 0 | 723 |

TABLE I-continued

| (FIG. 1) Stream Flow Summary - Lb. Moles/Hr [kg moles/Hr] | | | | | |
|---|---|---|---|---|---|
| 47 | 234 | 26 | 2 | 0 | 277 |
| 50 | 12,389 | 82 | 2 | 0 | 12,690 |
| 44 | 9 | 464 | 231 | 229 | 1,036 |

| Recoveries* | |
|---|---|
| Ethane | 85.00% |
| Propane | 99.11% |
| Butanes+ | 99.99% |

| Power | | |
|---|---|---|
| Residue Gas Compression | 5,548 HP | [9,121 kW] |
| Reflux Pump | 1 HP | [2 kW] |
| Totals | 5,549 HP | [9,123 kW] |

*(Based on un-rounded flow rates)

DESCRIPTION OF THE INVENTION

FIG. 2 illustrates a flow diagram of a process in accordance with the present invention. The feed gas composition and conditions considered in the process presented in FIG. 2 are the same as those in FIG. 1. Accordingly, the FIG. 2 process can be compared with that of the FIG. 1 process to illustrate the advantages of the present invention.

In the simulation of the FIG. 2 process, inlet gas enters the plant as stream 31 and is divided into two portions, streams 32 and 33. The first portion, stream 32, enters a heat exchange means in the upper region of feed cooling section 118*a* inside processing assembly 118. This heat exchange means may be comprised of a fin and tube type heat exchanger, a plate type heat exchanger, a brazed aluminum type heat exchanger, or other type of heat transfer device, including multi-pass and/or multi-service heat exchangers. The heat exchange means is configured to provide heat exchange between stream 32 flowing through one pass of the heat exchange means and a residue gas stream from condensing section 118*b* inside processing assembly 118 that has been heated in a heat exchange means in the lower region of feed cooling section 118*a*. Stream 32 is cooled while further heating the residue gas stream, with stream 32*a* leaving the heat exchange means at −30° F. [−35° C.].

The second portion, stream 33, enters a heat and mass transfer means in stripping section 118*e* inside processing assembly 118. This heat and mass transfer means may also be comprised of a fin and tube type heat exchanger, a plate type heat exchanger, a brazed aluminum type heat exchanger, or other type of heat transfer device, including multi-pass and/or multi-service heat exchangers. The heat and mass transfer means is configured to provide heat exchange between stream 33 flowing through one pass of the heat and mass transfer means and a distillation liquid stream flowing downward from absorbing section 118*d* inside processing assembly 118, so that stream 33 is cooled while heating the distillation liquid stream, cooling stream 33*a* to −42° F. [−41° C.] before it leaves the heat and mass transfer means. As the distillation liquid stream is heated, a portion of it is vaporized to form stripping vapors that rise upward as the remaining liquid continues flowing downward through the heat and mass transfer means. The heat and mass transfer means provides continuous contact between the stripping vapors and the distillation liquid stream so that it also functions to provide mass transfer between the vapor and liquid phases, stripping the liquid product stream 44 of methane and lighter components.

Streams 32*a* and 33*a* recombine to form stream 31*a*, which enters separator section 118*f* inside processing assembly 118 at −34° F. [−37° C.] and 900 psia [6,203 kPa(a)], whereupon the vapor (stream 34) is separated from the condensed liquid (stream 35). Separator section 118*f* has an internal head or other means to divide it from stripping section 118*e*, so that the two sections inside processing assembly 118 can operate at different pressures.

The vapor (stream 34) and the liquid (stream 35) from separator section 118*f* are each divided into two streams, streams 36 and 39 and streams 37 and 40, respectively. Stream 36, containing about 31% of the total vapor, is combined with stream 37, containing about 50% of the total liquid, and the combined stream 38 enters a heat exchange means in the lower region of feed cooling section 118*a* inside processing assembly 118. This heat exchange means may likewise be comprised of a fin and tube type heat exchanger, a plate type heat exchanger, a brazed aluminum type heat exchanger, or other type of heat transfer device, including multi-pass and/or multi-service heat exchangers. The heat exchange means is configured to provide heat exchange between stream 38 flowing through one pass of the heat exchange means and the residue gas stream from condensing section 118*b*, so that stream 38 is cooled to substantial condensation while heating the residue gas stream.

The resulting substantially condensed stream 38*a* at −128° F. [−89° C.] is then flash expanded through expansion valve 14 to the operating pressure (approximately 402 psia [2,772 kPa(a)]) of rectifying section 118*c* (an absorbing means) and absorbing section 118*d* (another absorbing means) inside processing assembly 118. During expansion a portion of the stream may be vaporized, resulting in cooling of the total stream. In the process illustrated in FIG. 2, the expanded stream 38*b* leaving expansion valve 14 reaches a temperature of −139° F. [−95° C.] and is supplied to processing assembly 118 between rectifying section 118*c* and absorbing section 118*d*.

The remaining 69% of the vapor from separator section 118*f* (stream 39) enters a work expansion machine 15 in which mechanical energy is extracted from this portion of the high pressure feed. The machine 15 expands the vapor substantially isentropically to the operating pressure of absorbing section 118*d*, with the work expansion cooling the expanded stream 39*a* to a temperature of approximately −100° F. [−73° C.]. The partially condensed expanded stream 39*a* is thereafter supplied as feed to the lower region of absorbing section 118*d* inside processing assembly 118 to be contacted by the liquids supplied to the upper region of absorbing section 118*d*. The remaining 50% of the liquid from separator section 118*f* (stream 40) is expanded to the operating pressure of stripping section 118*e* inside processing assembly 118 by expansion valve 17, cooling stream 40*a* to −60° F. [−51° C.]. The heat and mass transfer means in stripping section 118*e* is configured in upper and lower parts so that expanded liquid stream 40*a* can be introduced to stripping section 118*e* between the two parts.

A portion of the distillation vapor (first distillation vapor stream 45) is withdrawn from the upper region of stripping section 118*e* at −95° F. [−71° C.] and is directed to a heat exchange means in condensing section 118*b* inside processing assembly 118. This heat exchange means may likewise be comprised of a fin and tube type heat exchanger, a plate type heat exchanger, a brazed aluminum type heat exchanger, or other type of heat transfer device, including multi-pass and/or multi-service heat exchangers. The heat exchange means is configured to provide heat exchange between first distillation vapor stream 45 flowing through one pass of the heat exchange means and a second distillation vapor stream arising from rectifying section 118*c* inside processing assembly 118 so that the second distillation vapor stream is heated while it cools first distillation vapor stream 45. Stream 45 is cooled to −134° F. [−92° C.] and at least partially condensed, and thereafter exits the heat exchange means and is separated into its respective vapor and liquid phases. The vapor phase (if any) combines with the heated second distillation vapor stream exiting the heat exchange means to form the residue gas stream that provides cooling in feed cooling section 118*a* as described previously. The liquid phase (stream 48) is supplied as cold top column feed (reflux) to the upper region of rectifying section 118*c* inside processing assembly 118 by gravity flow.

Rectifying section 118*c* and absorbing section 118*d* each contain an absorbing means consisting of a plurality of vertically spaced trays, one or more packed beds, or some combination of trays and packing. The trays and/or packing in rectifying section 118*c* and absorbing section 118*d* provide the necessary contact between the vapors rising upward and cold liquid falling downward. The liquid portion of the expanded stream 39*a* comingles with liquids falling downward from absorbing section 118*d* and the combined liquid continues downward into stripping section 118*e*. The stripping vapors arising from stripping section 118*e* combine with the vapor portion of the expanded stream 39*a* and rise upward through absorbing section 118*d*, to be contacted with the cold liquid falling downward to condense and absorb most of the $C_2$ components, $C_3$ components, and heavier components from these vapors. The vapors arising from absorbing section 118*d* combine with any vapor portion of the expanded stream 38*b* and rise upward through rectifying section 118*c*, to be contacted with the cold liquid (stream 48) falling downward to condense and absorb most of the $C_3$ components and heavier components remaining in these vapors. The liquid portion of the expanded stream 38*b* comingles with liquids falling downward from rectifying section 118*c* and the combined liquid continues downward into absorbing section 118*d*.

The distillation liquid flowing downward from the heat and mass transfer means in stripping section 118*e* inside processing assembly 118 has been stripped of methane and lighter components. The resulting liquid product (stream 44) exits the lower region of stripping section 118*e* and leaves processing assembly 118 at 74° F. [23° C.]. The second distillation vapor stream arising from rectifying section 118*c* is warmed in condensing section 118*b* as it provides cooling to stream 45 as described previously. The warmed second distillation vapor stream combines with any vapor separated from the cooled first distillation vapor stream 45 as described previously. The resulting residue gas stream is heated in feed cooling section 118*a* as it provides cooling to streams 32 and 38 as described previously, whereupon residue gas stream 50 leaves processing assembly 118 at 104° F. [40° C.]. The residue gas stream is then re-compressed in two stages, compressor 16 driven by expansion machine 15 and compressor 23 driven by a supplemental power source. After cooling to 110° F. [43° C.] in discharge cooler 24, residue gas stream 50*c* flows to the sales gas pipeline at 915 psia [6,307 kPa(a)], sufficient to meet line requirements (usually on the order of the inlet pressure).

A summary of stream flow rates and energy consumption for the process illustrated in FIG. 2 is set forth in the following table:

TABLE II (FIG. 2)
Stream Flow Summary - Lb. Moles/Hr [kg moles/Hr]

| Stream | Methane | Ethane | Propane | Butanes+ | Total |
|---|---|---|---|---|---|
| 31 | 12,398 | 546 | 233 | 229 | 13,726 |
| 32 | 8,679 | 382 | 163 | 160 | 9,608 |
| 33 | 3,719 | 164 | 70 | 69 | 4,118 |
| 34 | 12,150 | 492 | 171 | 69 | 13,190 |
| 35 | 248 | 54 | 62 | 160 | 536 |
| 36 | 3,791 | 153 | 53 | 21 | 4,115 |
| 37 | 124 | 27 | 31 | 80 | 268 |
| 38 | 3,915 | 180 | 84 | 101 | 4,383 |
| 39 | 8,359 | 339 | 118 | 48 | 9,075 |
| 40 | 124 | 27 | 31 | 80 | 268 |
| 45 | 635 | 34 | 2 | 0 | 700 |
| 48 | 302 | 30 | 2 | 0 | 357 |
| 49 | 0 | 0 | 0 | 0 | 0 |
| 50 | 12,389 | 82 | 2 | 0 | 12,688 |
| 44 | 9 | 464 | 231 | 229 | 1,038 |

Recoveries*

| | |
|---|---|
| Ethane | 85.03% |
| Propane | 99.16% |
| Butanes+ | 99.98% |

Power

| | | |
|---|---|---|
| Residue Gas Compression | 5,274 HP | [8,670 kW] |

*(Based on un-rounded flow rates)

A comparison of Tables I and II shows that, compared to the prior art, the present invention maintains essentially the same ethane recovery (85.03% versus 85.00% for the prior art), slightly improves propane recovery from 99.11% to 99.16%, and maintains essentially the same butanes+ recovery (99.98% versus 99.99% for the prior art). However, further comparison of Tables I and II shows that the product yields were achieved using significantly less power than the prior art. In terms of the recovery efficiency (defined by the quantity of ethane recovered per unit of power), the present invention represents more than a 5% improvement over the prior art of the FIG. 1 process.

The improvement in recovery efficiency provided by the present invention over that of the prior art of the FIG. 1 process is primarily due to two factors. First, the compact arrangement of the heat exchange means in feed cooling section 118*a* and condensing section 118*b* and the heat and mass transfer means in stripping section 118*e* inside processing assembly 118 eliminates the pressure drop imposed by the interconnecting piping found in conventional processing plants. The result is that the residue gas flowing to compressor 16 is at higher pressure for the present invention compared to the prior art, so that the residue gas entering compressor 23 is at significantly higher pressure, thereby reducing the power required by the present invention to restore the residue gas to pipeline pressure.

Second, using the heat and mass transfer means in stripping section 118*e* to simultaneously heat the distillation liquid leaving absorbing section 118*d* while allowing the resulting vapors to contact the liquid and strip its volatile components is more efficient than using a conventional distillation column with external reboilers. The volatile components are stripped out of the liquid continuously, reducing the concentration of the volatile components in the stripping vapors more quickly and thereby improving the stripping efficiency for the present invention.

The present invention offers two other advantages over the prior art in addition to the increase in processing efficiency. First, the compact arrangement of processing assembly 118 of the present invention replaces eight separate equipment items in the prior art (heat exchangers 10, 11, 13, and 20, separator 12, reflux separator 21, reflux pump 22, and fractionation tower 18 in FIG. 1) with a single equipment item (processing assembly 118 in FIG. 2). This reduces the plot space requirements, eliminates the interconnecting piping, and eliminates the power consumed by the reflux pump, reducing the capital cost and operating cost of a process plant utilizing the present invention over that of the prior art. Second, elimination of the interconnecting piping means that a processing plant utilizing the present invention has far fewer flanged connections compared to the prior art, reducing the number of potential leak sources in the plant. Hydrocarbons are volatile organic compounds (VOCs), some of which are classified as greenhouse gases and some of which may be precursors to atmospheric ozone formation, which means the present invention reduces the potential for atmospheric releases that can damage the environment.

Other Embodiments

As described earlier for the embodiment of the present invention shown in FIG. 2, first distillation vapor stream 45 is partially condensed and the resulting condensate used to absorb valuable $C_3$ components and heavier components from the vapors rising through rectifying section 118*c* of processing assembly 118. However, the present invention is not limited to this embodiment. It may be advantageous, for instance, to treat only a portion of these vapors in this manner, or to use only a portion of the condensate as an absorbent, in cases where other design considerations indicate portions of the vapors or the condensate should bypass rectifying section 118*c* and/or absorbing section 118*d* of processing assembly 118. Some circumstances may favor total condensation, rather than partial condensation, of first distillation vapor stream 45 in condensing section 118*b*. Other circumstances may favor that first distillation vapor stream 45 be a total vapor side draw from stripping section 118*e* rather than a partial vapor side draw. It should also be noted that, depending on the composition of the feed as stream, it may be advantageous to use external refrigeration to provide partial cooling of first distillation vapor stream 45 in condensing section 118*b*.

If the feed gas is leaner, the quantity of liquid separated in stream 35 may be small enough that the additional mass transfer zone in stripping section 118*e* between expanded stream 39*a* and expanded liquid stream 40*a* shown in FIGS. 2, 4, 6, and 8 is not justified. In such cases, the heat and mass transfer means in stripping section 118*e* may be configured as a single section, with expanded liquid stream 40*a* introduced above the mass transfer means as shown in FIGS. 3, 5, 7, and 9. Some circumstances may favor combining the expanded liquid stream 40*a* with expanded stream 39*a* and thereafter supplying the combined stream to the lower region of absorbing section 118*d* as a single feed. Some circumstances may favor supplying all of liquid stream 35 directly to stripping section 118*e* via stream 40, or combining all of liquid stream 35 with stream 36 via stream 37. In the former case, there is no flow in stream 37 (as shown by the dashed lines in FIGS. 2 through 9) and only the vapor in stream 36 from separator section 118*f* (FIGS. 2 through 5) or separator 12 (FIGS. 6 through 9) flows to stream 38. In the latter case, the expansion device for stream 40 (such as expansion valve 17) is not needed (as shown by the dashed lines in FIGS. 3, 5, 7, and 9).

In some circumstances, it may be advantageous to use an external separator vessel to separate cooled feed stream 31*a*, rather than including separator section 118*f* in processing assembly 118. As shown in FIGS. 6 through 9, separator 12 can be used to separate cooled feed stream 31*a* into vapor stream 34 and liquid stream 35.

Some circumstances may favor using the cooled second portion (stream 33*a* in FIGS. 2 through 9) in lieu of the first portion (stream 36) of vapor stream 34 to form stream 38 flowing to the heat exchange means in the lower region of feed cooling section 118*a*. In such cases, only the cooled first portion (stream 32*a*) is supplied to separator section 118*f* (FIGS. 2 through 5) or separator 12 (FIGS. 6 through 9), and all of the resulting vapor stream 34 is supplied to work expansion machine 15.

Figure 3:
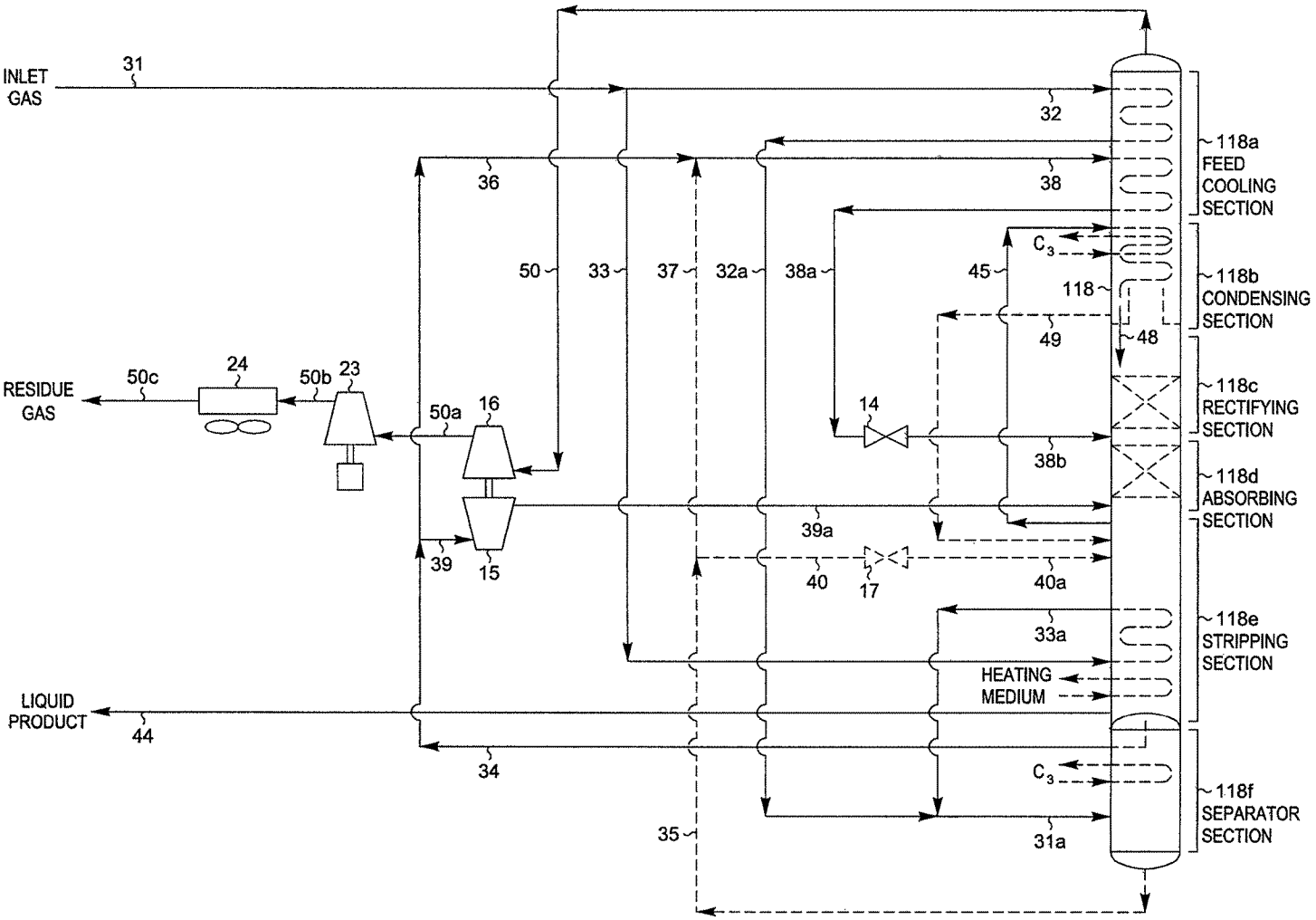
Figure 4:
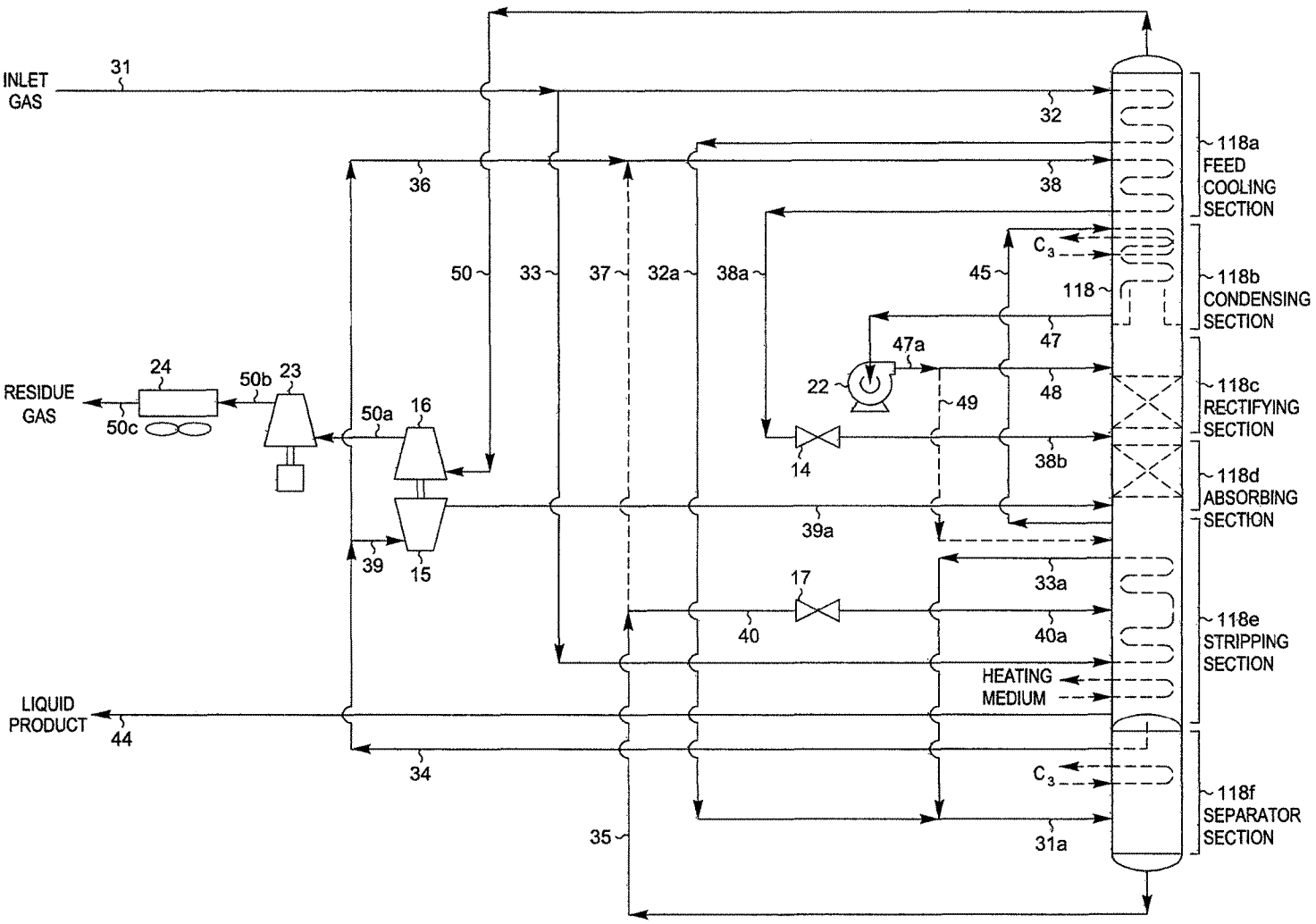
Figure 5:
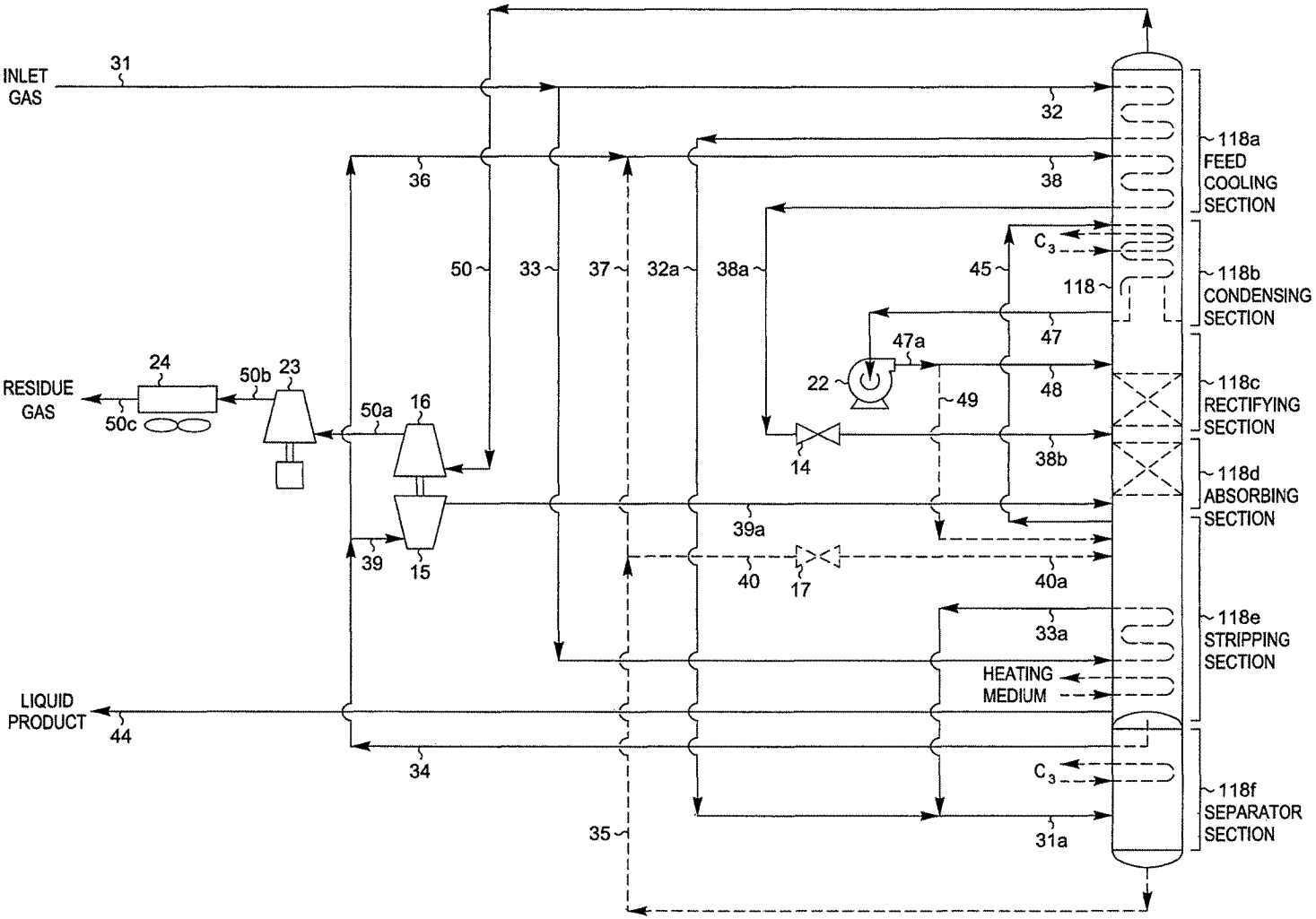
Figure 6:
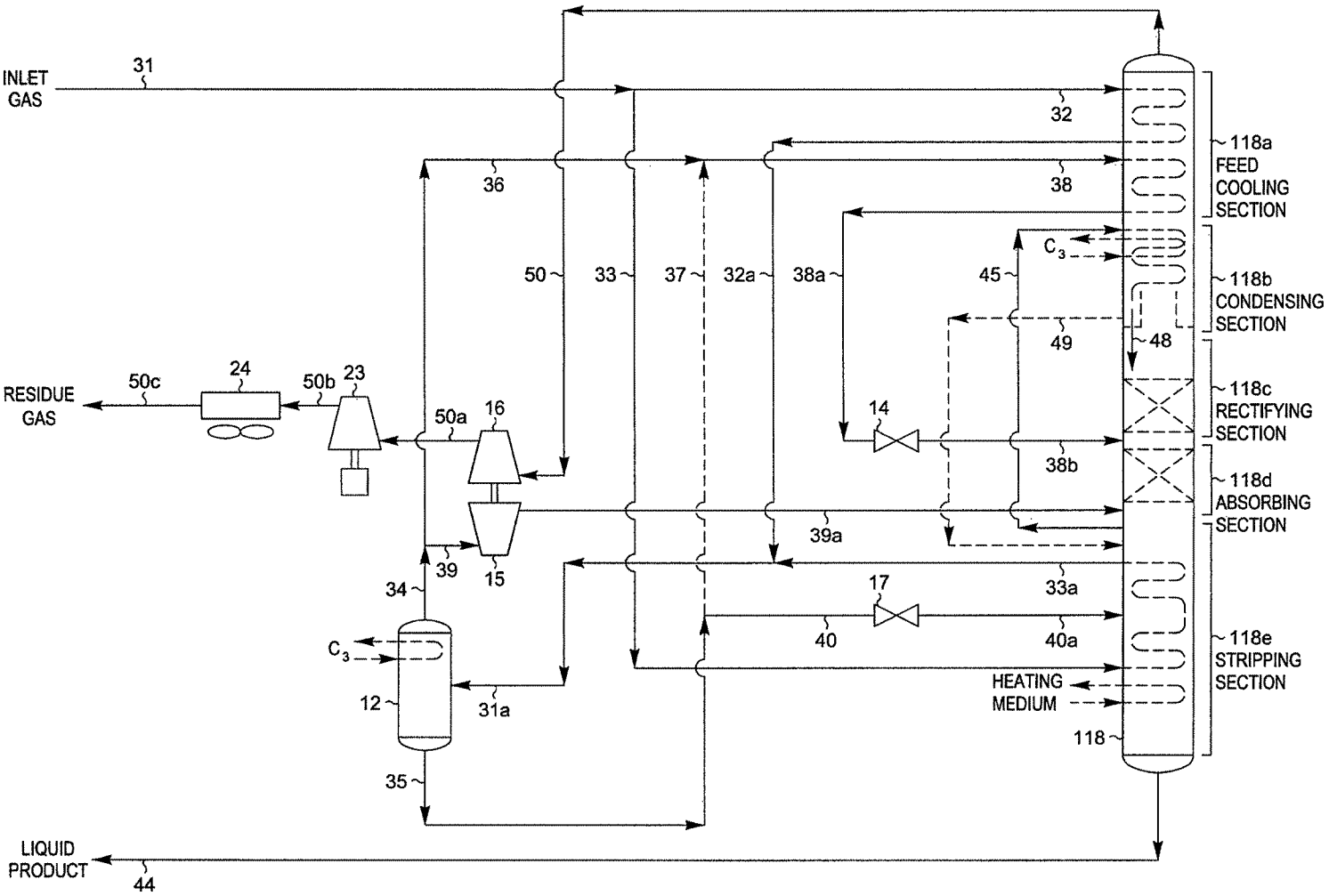
Figure 7:
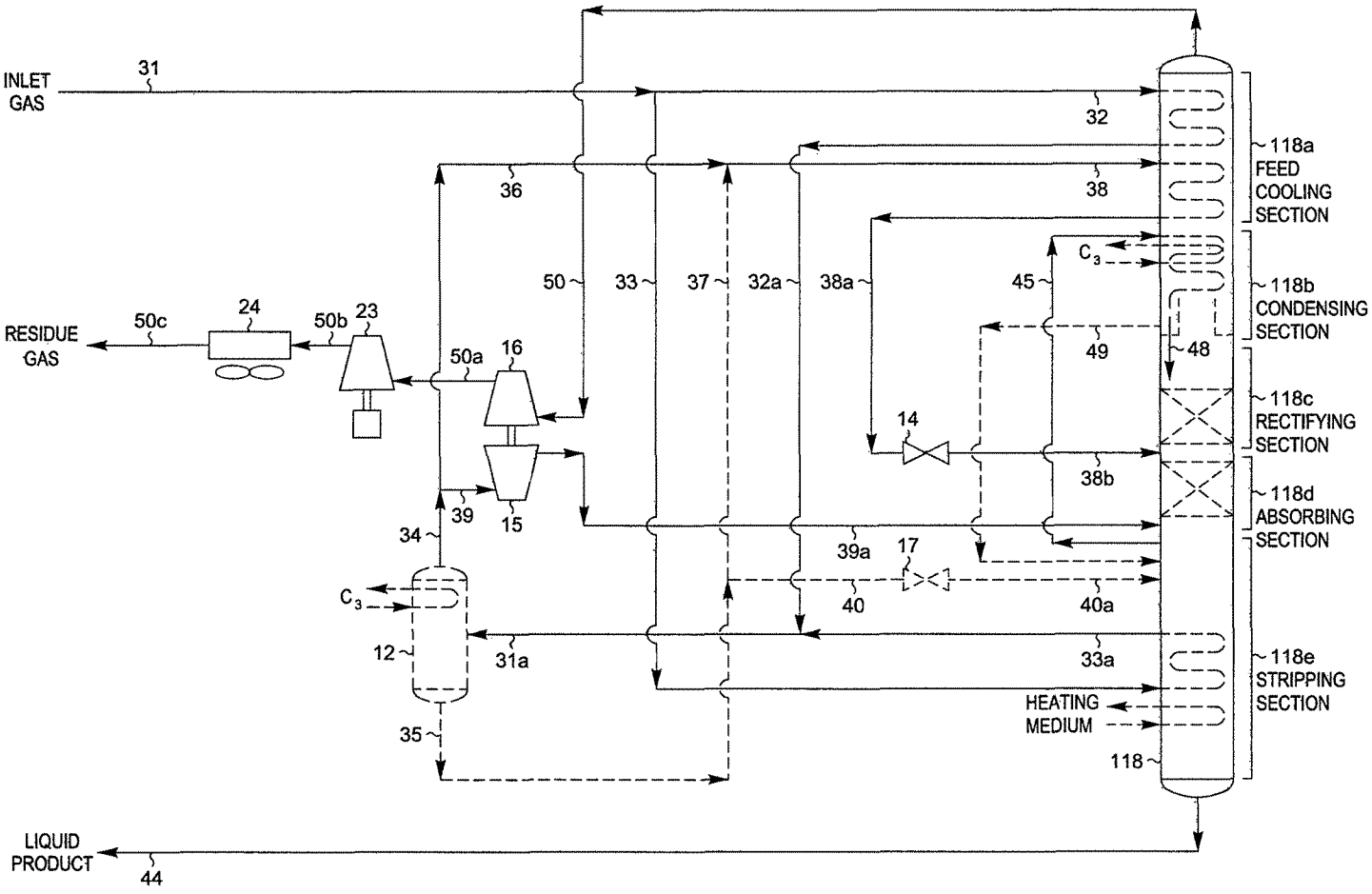
Figure 8:
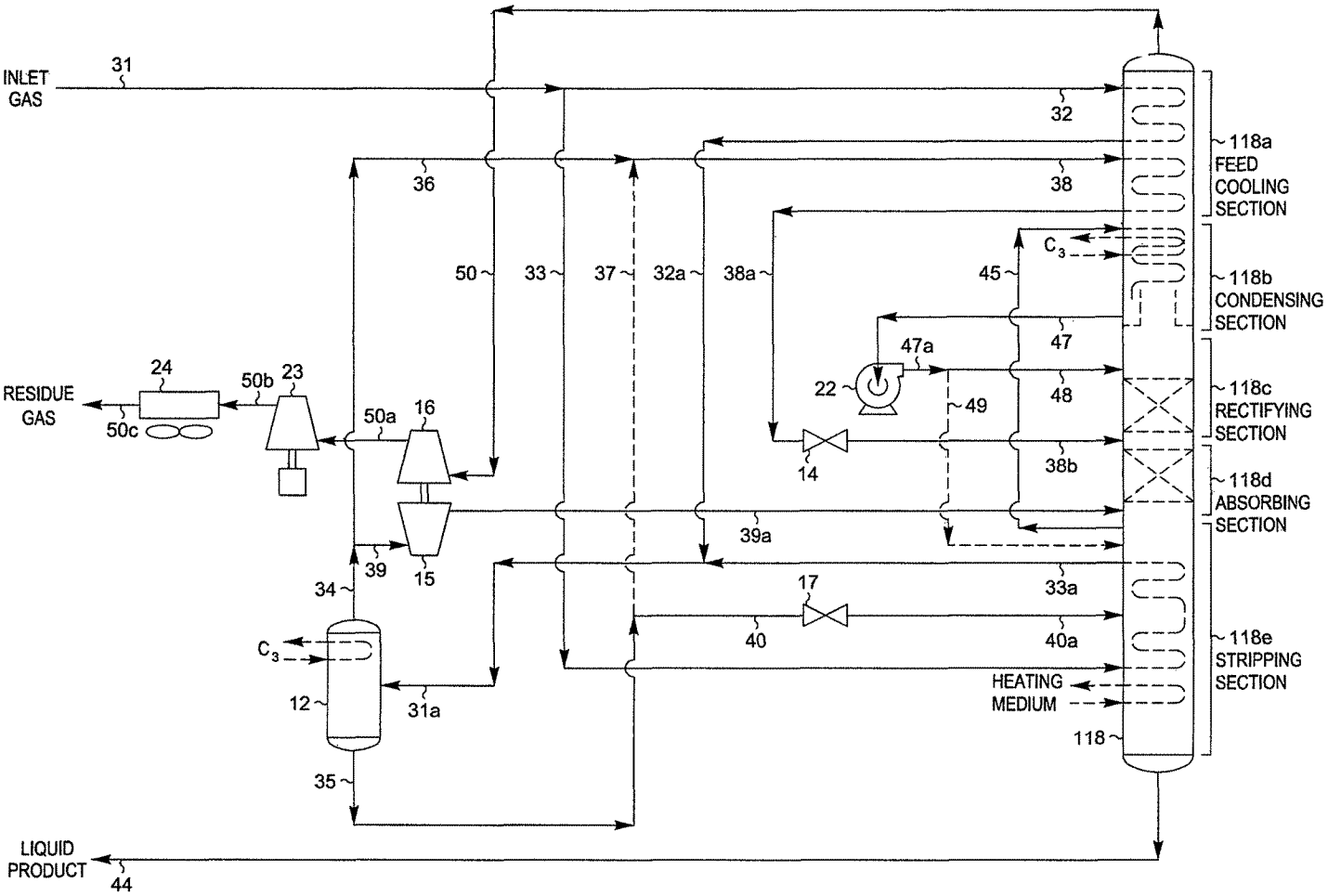
Figure 9:
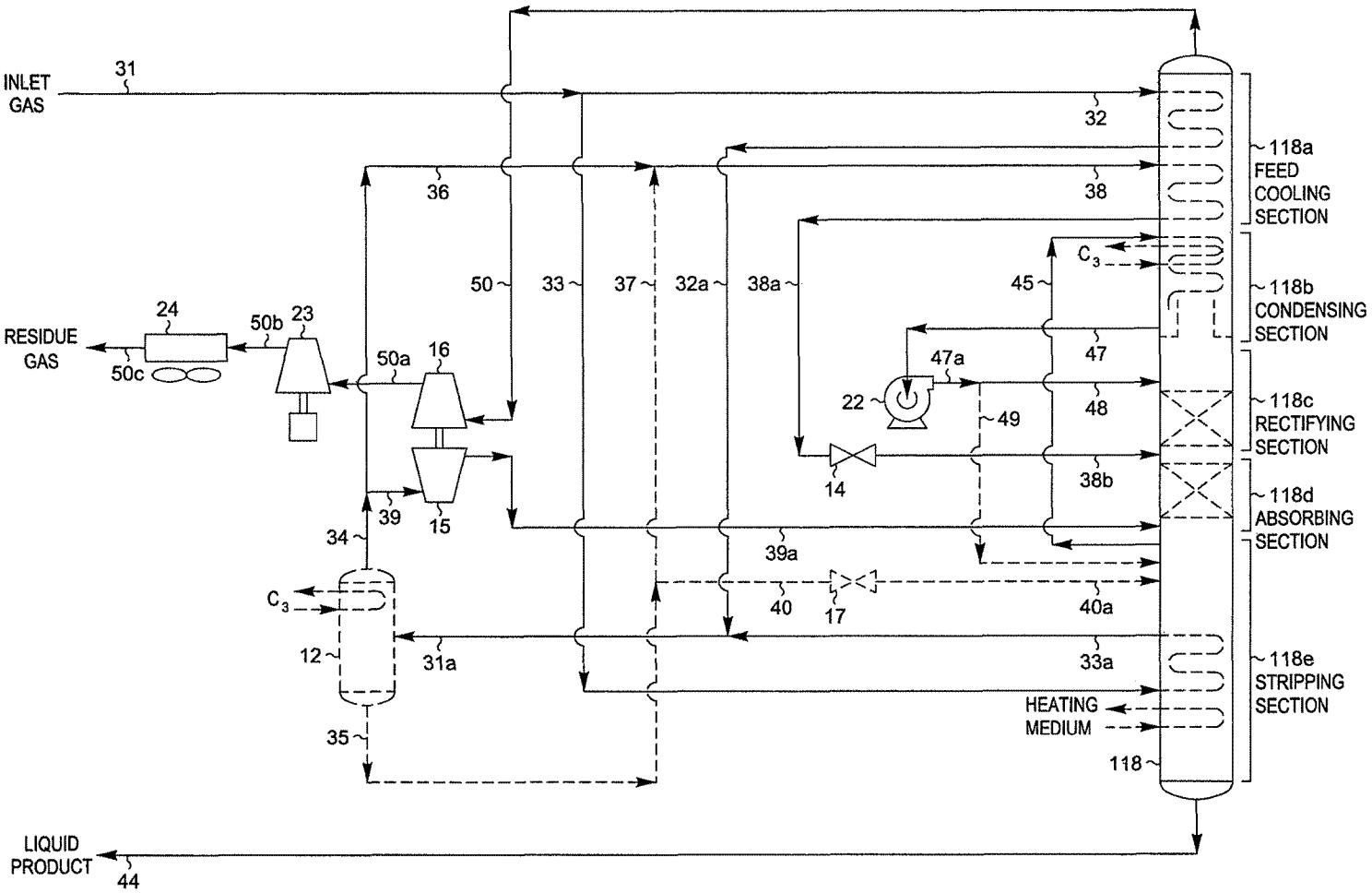

Depending on the quantity of heavier hydrocarbons in the feed gas and the feed gas pressure, the cooled feed stream 31*a* entering separator section 118*f* in FIGS. 3 and 5 or separator 12 in FIGS. 7 and 9 may not contain any liquid (because it is above its dewpoint, or because it is above its cricondenbar). In such cases, there is no liquid in streams 35 and 37 (as shown by the dashed lines), so only the vapor from separator section 118*f* in stream 36 (FIGS. 3 and 5) or the vapor from separator 12 in stream 36 (FIGS. 7 and 9) flows to stream 38 to become the expanded substantially condensed stream 38*b* supplied to processing assembly 118 between rectifying section 118*c* and absorbing section 118*d*. In such circumstances, separator section 118*f* in processing assembly 118 (FIGS. 3 and 5) or separator 12 (FIGS. 7 and 9) may not be required.

Feed gas conditions, plant size, available equipment, or other factors may indicate that elimination of work expansion machine 15, or replacement with an alternate expansion device (such as an expansion valve), is feasible. Although individual stream expansion is depicted in particular expansion devices, alternative expansion means may be employed where appropriate. For example, conditions may warrant work expansion of the substantially condensed portion of the feed stream (stream 38*a*).

In accordance with the present invention, the use of external refrigeration to supplement the cooling available to the inlet gas from the distillation vapor and liquid streams may be employed, particularly in the case of a rich inlet gas. In such cases, a heat and mass transfer means may be included in separator section 118*f* (or a gas collecting means in such cases when the cooled feed stream 31*a* contains no liquid) as shown by the dashed lines in FIGS. 2 through 5, or a heat and mass transfer means may be included in separator 12 as shown by the dashed lines in FIGS. 6 through 9. This heat and mass transfer means may be comprised of a fin and tube type heat exchanger, a plate type heat exchanger, a brazed aluminum type heat exchanger, or other type of heat transfer device, including multi-pass and/or multi-service heat exchangers. The heat and mass transfer means is configured to provide heat exchange between a refrigerant stream (e.g., propane) flowing through one pass of the heat and mass transfer means and the vapor portion of stream 31*a* flowing upward, so that the refrigerant further cools the vapor and condenses additional liquid, which falls downward to become part of the liquid removed in stream 35. Alternatively, conventional gas chiller(s) could be used to cool stream 32*a*, stream 33*a*, and/or stream 31a with refrigerant before stream 31a enters separator section 118f (FIGS. 2 through 5) or separator 12 (FIGS. 6 through 9).

Depending on the temperature and richness of the feed gas and the amount of $C_2$ components to be recovered in liquid product stream 44, there may not be sufficient heating available from stream 33 to cause the liquid leaving stripping section 118*e* to meet the product specifications. In such cases, the heat and mass transfer means in stripping section 118*e* may include provisions for providing supplemental heating with heating medium as shown by the dashed lines in FIGS. 2 through 9. Alternatively, another heat and mass transfer means can be included in the lower region of stripping section 118*e* for providing supplemental heating, or stream 33 can be heated with heating medium before it is supplied to the heat and mass transfer means in stripping section 118*e*.

Depending on the type of heat transfer devices selected for the heat exchange means in the upper and lower regions of feed cooling section 118*a* and/or in condensing section 118*b*, it may be possible to combine these heat exchange means in a single multi-pass and/or multi-service heat transfer device. In such cases, the multi-pass and/or multi-service heat transfer device will include appropriate means for distributing, segregating, and collecting stream 32, stream 38, stream 45, any vapor separated from the cooled stream 45, and the second distillation vapor stream in order to accomplish the desired cooling and heating.

Some circumstances may favor providing additional mass transfer in the upper region of stripping section 118*e*. In such cases, a mass transfer means can be located below where expanded stream 39*a* enters the lower region of absorbing section 118*d* and above where cooled second portion 33*a* leaves the heat and mass transfer means in stripping section 118*e*.

A less preferred option for the FIGS. 2 through 5 embodiments of the present invention is providing a separator vessel for cooled first portion 32*a* and a separator vessel for cooled second portion 33*a*, combining the vapor streams separated therein to form vapor stream 34, and combining the liquid streams separated therein to form liquid stream 35. Another less preferred option for the present invention is cooling stream 37 in a separate heat exchange means inside feed cooling section 118*a* (rather than combining stream 37 with stream 36 to form combined stream 38), expanding the cooled stream in a separate expansion device, and supplying the expanded stream to an intermediate region in absorbing section 118*d*.

In some circumstances, particularly when lower levels of $C_2$ component recovery are desirable, it may be advantageous to provide reflux for the upper region of stripping section 118*e*. In such cases, the liquid phase of cooled stream 45 leaving the heat exchange means in condensing section 118*b* can be split into two portions, stream 48 and stream 49. Stream 48 is supplied to rectifying section 118*c* as its top feed, while stream 49 is supplied to the upper region of stripping section 118*e* so that it can partially rectify the distillation vapor in this section of processing assembly 118 before first distillation vapor stream 45 is withdrawn. In some cases, gravity flow of streams 48 and 49 may be adequate (FIGS. 2, 3, 6, and 7), while in other cases pumping of the liquid phase (stream 47) with reflux pump 22 may be desirable (FIGS. 4, 5, 8, and 9). The relative amount of the liquid phase that is split between streams 48 and 49 will depend on several factors, including gas pressure, feed gas composition, the desired $C_2$ component recovery level, and the quantity of horsepower available. The optimum split generally cannot be predicted without evaluating the particular circumstances for a specific application of the present invention. Some circumstances may favor feeding all of the liquid phase as the top feed to rectifying section 118*c* in stream 48 and none to the upper region of stripping section 118*e* in stream 49, as shown by the dashed lines for stream 49.

It will be recognized that the relative amount of feed found in each branch of the split vapor feed will depend on several factors, including gas pressure, feed gas composition, the amount of heat which can economically be extracted from the feed, and the quantity of horsepower available. More feed above absorbing section 118*d* may increase recovery while decreasing power recovered from the expander and thereby increasing the recompression horsepower requirements. Increasing feed below absorbing section 118*d* reduces the horsepower consumption but may also reduce product recovery.

The present invention provides improved recovery of $C_2$ components, $C_3$ components, and heavier hydrocarbon components or of $C_3$ components and heavier hydrocarbon components per amount of utility consumption required to operate the process. An improvement in utility consumption required for operating the process may appear in the form of reduced power requirements for compression or re-compression, reduced power requirements for external refrigeration, reduced energy requirements for supplemental heating, reduced energy requirements for tower reboiling, or a combination thereof.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. A process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components wherein (1) said gas stream is divided into first and second portions;

(2) said first portion is cooled;

(3) said second portion is cooled;

(4) said cooled first portion is combined with said cooled second portion to form a cooled gas stream;

(5) said cooled gas stream is divided into first and second streams;

(6) said first stream is cooled to condense substantially all of it and is thereafter expanded to lower pressure whereby it is further cooled;

(7) said expanded cooled first stream is supplied as a feed between first and second absorbing means housed in a single equipment item processing assembly, said first absorbing means being located above said second absorbing means;

(8) said second stream is expanded to said lower pressure and is supplied as a bottom feed to said second absorbing means;

(9) a distillation liquid stream is collected from a lower region of said second absorbing means and heated in a means for providing heat and mass transfer that is housed in said processing assembly, said means for providing heat and mass transfer being configured to provide heat exchange between (a) said second portion flowing through one pass of said means for providing heat and mass transfer and (b) said distillation liquid stream flowing downward from said second absorbing means, so that said second portion is cooled while heating said distillation liquid stream before it leaves said means for providing heat and mass transfer; and wherein as said distillation liquid stream is heated, a portion of it is vaporized to form stripping vapors that rise upward as the remaining liquid continues flowing downward through said means for providing heat and mass transfer; and wherein said means for providing heat and mass transfer provides continuous contact between said stripping vapors and said remaining liquid so that said means for providing heat and mass transfer also functions to provide mass transfer between vapor and liquid phases, stripping said remaining liquid of methane and lighter components; and wherein said means for providing heat and mass transfer supplies at least a portion of the cooling of step (3) while simultaneously stripping the more volatile components from said distillation liquid stream, and thereafter discharging said heated and stripped remaining liquid from said processing assembly as said relatively less volatile fraction; wherein said means for providing heat and mass transfer does not include external reboilers;

(10) a first distillation vapor stream is collected from an upper region of said means for providing heat and mass transfer and cooled sufficiently to condense at least a part of it, thereby forming a condensed stream and a residual vapor stream containing uncondensed vapor remaining after said first distillation vapor stream is cooled;

(11) at least a portion of said condensed stream is supplied as a top feed to said first absorbing means;

(12) a second distillation vapor stream is collected from an upper region of said first absorbing means and heated;

(13) said heated second distillation vapor stream is combined with said residual vapor stream to form a combined vapor stream;

(14) said combined vapor stream is heated, thereafter discharging said heated combined vapor stream from said processing assembly as said volatile residue gas fraction;

(15) said heating of said second distillation vapor stream and said combined vapor stream is accomplished in one or more means for providing heat exchange that is housed in said processing assembly, said one or more means for providing heat exchange being configured to provide heat exchange between (a) said first distillation vapor stream flowing through one pass of said one or more means for providing heat exchange, and (b) said second distillation vapor stream arising from said first absorbing means inside said processing assembly, so that said first distillation vapor stream is cooled to at least partial condensation while heating said second distillation vapor stream, thereby forming said condensed stream and said residual vapor stream; and wherein said one or more means for providing heat exchange is further configured to provide heat exchange between (c) said first stream flowing through another pass of said one or more means for providing heat exchange, and (d) said combined vapor stream flowing through said another pass of said one or more means for providing heat exchange inside said processing assembly, so that said first stream is cooled to substantial condensation while heating said combined vapor stream; and wherein said one or more means for providing heat exchange is further configured to provide heat exchange between (e) said first portion flowing through a further pass of said one or more means for providing heat exchange, and (f) said heated combined vapor stream arising from said another pass of said one or more means for providing heat exchange inside said processing assembly, so that said first portion is cooled while further heating said heated combined vapor stream to form said volatile residue gas fraction, and wherein said one or more means for providing heat exchange supplies at least a portion of the cooling of steps (2), (6), and (10); wherein said one or more heat exchange means does not include external reflux equipment items; and

(16) the quantities and temperatures of said feed streams to said first and second absorbing means are effective to maintain the temperature of said upper region of said first absorbing means at a temperature whereby the major portions of the components in said relatively less volatile fraction are recovered.

2. The process according to claim 1 wherein (a) said cooled first portion is combined with said cooled second portion to form a partially condensed gas stream;

(b) said partially condensed gas stream is supplied to a separating means and is separated therein to provide a vapor stream and at least one liquid stream;

(c) said vapor stream is divided into said first and second streams; and (d) at least a portion of said at least one liquid stream is expanded to said lower pressure and is supplied as a feed to said processing assembly below said second absorbing means and above said heat and mass transfer means.

3. The process according to claim 2 wherein (a) said first stream is combined with said at least one liquid stream to form a combined stream;

(b) said combined stream is cooled to condense substantially all of it and is thereafter expanded to lower pressure whereby it is further cooled;

(c) said expanded cooled combined stream is supplied as said feed between said first and second absorbing means; and (d) said heating of said second distillation vapor stream and said combined vapor stream is accomplished in said one or more means for providing heat exchange housed in said processing assembly, thereby to supply at least a portion of the cooling of steps (2), (10), and (b).

4. The process according to claim 2 wherein said separating means is housed in said processing assembly.

5. The process according to claim 3 wherein said separating means is housed in said processing assembly.

6. The process according to claim 2 wherein (1) said means for providing heat and mass transfer is arranged in upper and lower regions; and (2) said expanded at least a portion of said at least one liquid stream is supplied to said processing assembly to enter between said upper and lower regions of said means for providing heat and mass transfer.

7. The process according to claim 4 wherein (1) said heat and mass transfer means is arranged in upper and lower regions; and (2) said expanded at least a portion of said at least one liquid stream is supplied to said processing assembly to enter between said upper and lower regions of said means for providing heat and mass transfer.

8. The process according to claim 1 wherein (1) a gas collecting means is housed in said processing assembly;

(2) an additional means for providing heat and mass transfer is included inside said gas collecting means, said additional means for providing heat and mass transfer including one or more passes for an external refrigeration medium;

(3) said cooled gas stream is supplied to said gas collecting means and directed to said additional means for providing heat and mass transfer to be further cooled by said external refrigeration medium; and (4) said further cooled gas stream is divided into said first and second streams.

9. An apparatus for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components comprising (1) first dividing means to divide said gas stream into first and second portions;

(2) one or more means for providing heat exchange housed in a single equipment item processing assembly and connected to said first dividing means to receive said first portion and cool it;

(3) means for providing heat and mass transfer housed in said processing assembly and connected to said first dividing means to receive said second portion and cool it;

(4) first combining means connected to said one or more means for providing heat exchange and said means for providing heat and mass transfer to receive said cooled first portion and said cooled second portion and form a cooled gas stream;

(5) second dividing means connected to said first combining means to receive said cooled gas stream and divide it into first and second streams;

(6) said one or more means for providing heat exchange being further connected to said second dividing means to receive said first stream and cool it sufficiently to substantially condense it;

(7) first expansion means connected to said one or more means for providing heat exchange to receive said substantially condensed first stream and expand it to lower pressure;

(8) first and second absorbing means housed in said processing assembly and connected to said first expansion means to receive said expanded cooled first stream as a feed thereto between said first and second absorbing means, said first absorbing means being located above said second absorbing means;

(9) second expansion means connected to said second dividing means to receive said second stream and expand it to said lower pressure, said second expansion means being further connected to said second absorbing means to supply said expanded second stream as a bottom feed thereto;

(10) liquid collecting means housed in said processing assembly and connected to said second absorbing means to receive a distillation liquid stream from a lower region of said second absorbing means;

(11) said means for providing heat and mass transfer being further connected to said liquid collecting means to receive said distillation liquid stream and heat it, said means for providing heat and mass transfer being configured to provide heat exchange between (a) said second portion flowing through one pass of said means for providing heat and mass transfer and (b) said distillation liquid stream flowing downward from said second absorbing means, so that said second portion is cooled while heating said distillation liquid stream before it leaves said means for providing heat and mass transfer; and wherein as said distillation liquid stream is heated, a portion of it is vaporized to form stripping vapors that rise upward as the remaining liquid continues flowing downward through said means for providing heat and mass transfer, and wherein said means for providing heat and mass transfer provides continuous contact between said stripping vapors and said remaining liquid so that said means for providing heat and mass transfer also functions to provide mass transfer between vapor and liquid phases, stripping said remaining liquid of methane and lighter components; and wherein said means for providing heat and mass transfer supplies at least a portion of the cooling of step (3) while simultaneously stripping the more volatile components from said distillation liquid stream, and thereafter discharging said heated and stripped remaining liquid from said processing assembly as said relatively less volatile fraction; wherein said means for providing heat and mass transfer does not include external reboilers;

(12) first vapor collecting means housed in said processing assembly and connected to said means for providing heat and mass transfer to receive a first distillation vapor stream from an upper region of said means for providing heat and mass transfer;

(13) said one or more means for providing heat exchange being further connected to said first vapor collecting means to receive said first distillation vapor stream and cool it sufficiently to condense at least a part of it, thereby forming a condensed stream and a residual vapor stream containing any uncondensed vapor remaining after said first distillation vapor stream is cooled;

(14) said first absorbing means being further connected to said one or more means for providing heat exchange to receive at least a portion of said condensed stream as a top feed thereto;

(15) second vapor collecting means housed in said processing assembly and connected to said first absorbing means to receive a second distillation vapor stream from an upper region of said first absorbing means;

(16) said one or more means for providing heat exchange being further connected to said second vapor collecting means to receive said second distillation vapor stream and heat it, thereby to supply at least a portion of the cooling of step (13);

(17) second combining means connected to said one or more means for providing heat exchange to receive said heated second distillation vapor stream and any said residual vapor stream and form a combined vapor stream;

(18) said one or more means for providing heat exchange being further connected to said second combining means to receive said combined vapor stream and heat it, thereby to supply at least a portion of the cooling of steps (2) and (6), and thereafter discharging said heated combined vapor stream from said processing assembly as said volatile residue gas fraction; said one or more means for providing heat exchange being configured to provide heat exchange between (a) said first distillation vapor stream flowing through one pass of said one or more means for providing heat exchange, and (b) said second distillation vapor stream arising from said first absorbing means inside said processing assembly, so that said first distillation vapor stream is cooled to at least partial condensation while heating said second distillation vapor stream, thereby forming said condensed stream and said residual vapor stream; and wherein said one or more means for providing heat exchange is further configured to provide heat exchange between (c) said first stream flowing through another pass of said one or more means for providing heat exchange, and (d) said combined vapor stream flowing through said another pass of said one or more means for providing heat exchange inside said processing assembly, so that said first stream is cooled to substantial condensation while heating said combined vapor stream; and wherein said one or more means for providing heat exchange is further configured to provide heat exchange between (e) said first portion flowing through a further pass of said one or more means for providing heat exchange, and (f) said heated combined vapor stream arising from said another pass of said one or more means for providing heat exchange inside said processing assembly, so that first portion is cooled while further heating said heated combined vapor stream to form said volatile residue gas fraction, wherein said one or more heat exchange means does not include external reflux equipment items; and

(19) control means adapted to regulate the quantities and temperatures of said feed streams to said first and second absorbing means to maintain the temperature of said upper region of said first absorbing means at a temperature whereby the major portions of the components in said relatively less volatile fraction are recovered.

10. The apparatus according to claim 9 wherein (a) the first combining means is adapted to receive said cooled first portion and said cooled second portion and form a partially condensed gas stream;

(b) a separating means is connected to said first combining means to receive said partially condensed gas stream and separate it into a vapor stream and at least one liquid stream;

(c) said second dividing means is connected to said separating means to receive said vapor stream and divide it into said first and second streams; and (d) a third expansion means is connected to said separating means to receive at least a portion of said at least one liquid stream and expand it to said lower pressure, said third expansion means being further connected to said processing assembly to supply said expanded at least a portion of said at least one liquid stream as a feed thereto below said second absorbing means and above said means for providing heat and mass transfer.

11. The apparatus according to claim 10 wherein (a) a third combining means is connected to said second dividing means and said separating means to receive said first stream and said at least one liquid stream and form a combined stream;

(b) said one or more means for providing heat exchange is further connected to said third combining means to receive said combined stream and cool it sufficiently to substantially condense it;

(c) said first expansion means is connected to said one or more means for providing heat exchange to receive said substantially condensed combined stream and expand it to lower pressure;

(d) said first and second absorbing means are connected to said first expansion means to receive said expanded cooled combined stream as said feed thereto between said first and second absorbing means; and (e) said one or more means for providing heat exchange being further connected to said second combining means to receive said combined vapor stream and heat it, thereby to supply at least a portion of the cooling of steps (2) and (b).

12. The apparatus according to claim 10 wherein said separating means is housed in said processing assembly.

13. The apparatus according to claim 11 wherein said separating means is housed in said processing assembly.

14. The apparatus according to claim 10 wherein (1) said means for providing heat and mass transfer is arranged in upper and lower regions; and (2) said processing assembly is connected to said third expansion means to receive said expanded at least a portion of said at least one liquid stream and direct it between said upper and lower regions of said heat and mass transfer means.

15. The apparatus according to claim 9 wherein (1) a gas collecting means is housed in said processing assembly;

(2) an additional means for providing heat and mass transfer is included inside said gas collecting means, said additional means for providing heat and mass transfer including one or more passes for an external refrigeration medium;

(3) said gas collecting means is connected to said first combining means to receive said cooled gas stream and direct it to said additional means for providing heat and mass transfer to be further cooled by said external refrigeration medium; and (4) said second dividing means is adapted to be connected to said gas collecting means to receive said further cooled gas stream and divide it into said first and second streams.

16. A process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components wherein (1) said gas stream is divided into first and second portions;

(2) said first portion is cooled;

(3) said second portion is cooled;

(4) said cooled first portion is combined with said cooled second portion to form a cooled gas stream;

(5) said cooled gas stream is divided into first and second streams;

(6) said first stream is cooled to condense substantially all of it and is thereafter expanded to lower pressure whereby it is further cooled;

(7) said expanded cooled first stream is supplied as a feed between first and second absorbing means housed in a single equipment item processing assembly, said first absorbing means being located above said second absorbing means;

(8) said second stream is expanded to said lower pressure and is supplied as a bottom feed to said second absorbing means;

(9) a distillation liquid stream is collected from a lower region of said second absorbing means and heated in a heat and mass transfer means housed in said processing assembly, said means for providing heat and mass transfer being configured to provide heat exchange between (a) said second portion flowing through one pass of said means for providing heat and mass transfer and (b) said distillation liquid stream flowing downward from said second absorbing means, so that said second portion is cooled while heating said distillation liquid stream before it leaves said means for providing heat and mass transfer; and wherein as said distillation liquid stream is heated, a portion of it is vaporized to form stripping vapors that rise upward as the remaining liquid continues flowing downward through said means for providing heat and mass transfer; and wherein said means for providing heat and mass transfer provides continuous contact between said stripping vapors and said remaining liquid so that said means for providing heat and mass transfer also functions to provide mass transfer between vapor and liquid phases, stripping said remaining liquid of methane and lighter components; and wherein said means for providing heat and mass transfer supplies at least a portion of the cooling of step (3) while simultaneously stripping the more volatile components from said distillation liquid stream, and thereafter discharging said heated and stripped remaining liquid from said processing assembly as said relatively less volatile fraction; wherein said means for providing heat and mass transfer does not include external reboilers;

(10) a first distillation vapor stream is collected from an upper region of said means for providing heat and mass transfer and cooled sufficiently to condense it, thereby forming a condensed stream;

(11) at least a portion of said condensed stream is supplied as a top feed to said first absorbing means;

(12) a second distillation vapor stream is collected from an upper region of said first absorbing means and heated, thereafter discharging said heated second distillation vapor stream from said processing assembly as said volatile residue gas fraction;

(13) said heating of said second distillation vapor stream is accomplished in one or more means for providing heat exchange that is housed in said processing assembly, said one or more means for providing heat exchange being configured to provide heat exchange between (a) said first distillation vapor stream flowing through one pass of said one or more means for providing heat exchange, and (b) said second distillation vapor stream arising from said first absorbing means inside said processing assembly, so that said first distillation vapor stream is cooled sufficiently to condense it while heating said second distillation vapor stream, thereby forming said condensed stream and said residue gas fraction; and wherein said one or more means for providing heat exchange is further configured to provide heat exchange between (c) said first stream flowing through another pass of said one or more means for providing heat exchange, and (d) said second distillation vapor stream flowing through said another pass of said one or more means for providing heat exchange inside said processing assembly, so that said first stream is cooled to substantial condensation while heating said second distillation vapor stream; and wherein said one or more means for providing heat exchange is further configured to provide heat exchange between (e) said first portion flowing through a further pass of said one or more means for providing heat exchange, and (f) said heated second distillation vapor stream arising from said another pass of said one or more means for providing heat exchange inside said processing assembly, so that said first portion is cooled while further heating said heated second distillation vapor stream to form said volatile residue gas fraction, and wherein said one or more means for providing heat exchange supplies at least a portion of the cooling of steps (2), (6), and (10); wherein said one or more means for providing heat exchange does not include external reflux equipment items; and

(14) the quantities and temperatures of said feed streams to said first and second absorbing means are effective to maintain the temperature of said upper region of said first absorbing means at a temperature whereby the major portions of the components in said relatively less volatile fraction are recovered.

17. The process according to claim 2 wherein (a) said first stream is combined with a portion of said at least one liquid stream to form a combined stream;

(b) said combined stream is cooled to condense substantially all of it and is thereafter expanded to lower pressure whereby it is further cooled;

(c) said expanded cooled combined stream is supplied as said feed between said first and second absorbing means;

(d) a remaining portion of said at least one liquid stream is expanded to said lower pressure and is supplied as said feed to said processing assembly below said second absorbing means and above said means for providing heat and mass transfer; and (e) said heating of said second distillation vapor stream and said combined vapor stream is accomplished in said one or more means for providing heat exchange housed in said processing assembly, thereby to supply at least a portion of the cooling of steps (2), (10), and (b).

18. The apparatus according to claim 10 wherein (a) a third combining means is connected to said second dividing means and said separating means to receive said first stream and a portion of said at least one liquid stream and form a combined stream;

(b) said one or more means for providing heat exchange is further connected to said third combining means to receive said combined stream and cool it sufficiently to substantially condense it;

(c) said first expansion means is connected to said one or more means for providing heat exchange to receive said substantially condensed combined stream and expand it to lower pressure;

(d) said first and second absorbing means are connected to said first expansion means to receive said expanded cooled combined stream as said feed thereto between said first and second absorbing means;

(e) said third expansion means is connected to said separating means to receive a remaining portion of said at least one liquid stream and expand it to said lower pressure, said third expansion means being further connected to said processing assembly to supply said expanded remaining portion of said at least one liquid stream as said feed thereto below said second absorbing means and above said heat and mass transfer means; and (f) said one or more means for providing heat exchange being further connected to said second combining means to receive said combined vapor stream and heat it, thereby to supply at least a portion of the cooling of steps (2) and (b).

19. The process according to claim 17 wherein (1) said heat and mass transfer means is arranged in upper and lower regions; and (2) said expanded remaining portion of said at least one liquid stream is supplied to said processing assembly to enter between said upper and lower regions of said means for providing heat and mass transfer.

20. The process according to claim 17 wherein (1) said heat and mass transfer means is arranged in upper and lower regions; and (2) said expanded remaining portion of said at least one liquid stream is supplied to said processing assembly to enter between said upper and lower regions of said means for providing heat and mass transfer.

21. The process according to claim 2, 3, 4, 5, 6, 19, 7, or 20 wherein (1) an additional means for providing heat and mass transfer is included inside said separating means, said additional means for providing heat and mass transfer including one or more passes for an external refrigeration medium;

(2) said vapor stream is directed to said additional means for providing heat and mass transfer to be cooled by said external refrigeration medium to form additional condensate; and (3) said additional condensate becomes a part of said at least one liquid stream separated therein.

22. The process according to claim 1, 2, 3, 4, 5, 6, 19, 7, 20 or 10 wherein (1) said condensed stream is divided into at least first and second reflux streams;

(2) said first reflux stream is supplied as said top feed to said first absorbing means; and (3) said second reflux stream is supplied as a feed to said processing assembly below said second absorbing means and above said means for providing heat and mass transfer.

23. The process according to claim 21 wherein (1) said condensed stream is divided into at least first and second reflux streams;

(2) said first reflux stream is supplied as said top feed to said first absorbing means; and (3) said second reflux stream is supplied as a feed to said processing assembly below said second absorbing means and above said means for providing heat and mass transfer.

24. The process according to claim 1, 2, 3, 4, 5, 6, 19, 7, 20, or 8 wherein said means for providing heat and mass transfer includes one or more passes for an external heating medium to supplement the heating supplied by said second portion for said stripping of said more volatile components from said distillation liquid stream.

25. The process according to claim 21 wherein said means for providing heat and mass transfer includes one or more passes for an external heating medium to supplement the heating supplied by said second portion for said stripping of said more volatile components from said distillation liquid stream.

26. The process according to claim 22 wherein said means for providing heat and mass transfer includes one or more passes for an external heating medium to supplement the heating supplied by said second portion for said stripping of said more volatile components from said distillation liquid stream.

27. The process according to claim 23 wherein said means for providing heat and mass transfer includes one or more passes for an external heating medium to supplement the heating supplied by said second portion for said stripping of said more volatile components from said distillation liquid stream.

28. The apparatus according to claim 18 wherein (1) said means for providing heat and mass transfer is arranged in upper and lower regions, and (2) said processing assembly is connected to said third expansion means to receive said expanded remaining portion of said at least one liquid stream and direct it between said upper and lower regions of said means for providing heat and mass transfer.

29. The apparatus according to claim 18 wherein (1) said means for providing heat and mass transfer is arranged in upper and lower regions; and (2) said processing assembly is connected to said third expansion means to receive said expanded at least a portion of said at least one liquid stream and direct it between said upper and lower regions of said means for providing heat and mass transfer.

30. The apparatus according to claim 18 wherein (1) said means for providing heat and mass transfer is arranged in upper and lower regions, and (2) said processing assembly is connected to said third expansion means to receive said expanded remaining portion of said at least one liquid stream and direct it between said upper and lower regions of said means for providing heat and mass transfer.

31. The apparatus according to claim 10, 11, 12, 13, 14, 28, 29, or 30 wherein (1) an additional means for providing heat and mass transfer is included inside said separating means, said additional means for providing heat and mass transfer including one or more passes for an external refrigeration medium;

(2) said vapor stream is directed to said additional means for providing heat and mass transfer to be cooled by said external refrigeration medium to form additional condensate; and (3) said additional condensate becomes a part of said at least one liquid stream separated therein.

32. The apparatus according to claim 9, 10, 11, 12, 13, 14, 28, 29, 30, or 15 wherein (1) a third dividing means is connected to said one or more means for providing heat exchange to receive said condensed stream and divide it into at least first and second reflux streams;

(2) said first absorbing means is adapted to be connected to said third dividing means to receive said first reflux stream as said top feed thereto; and (3) said means for providing heat and mass transfer is adapted to be connected to said third dividing means to receive said second reflux stream as a top feed thereto.

33. The apparatus according to claim 31 wherein (1) a third dividing means is connected to said one or more means for providing heat exchange to receive said condensed stream and divide it into at least first and second reflux streams;

(2) said first absorbing means is adapted to be connected to said third dividing means to receive said first reflux stream as said top feed thereto; and (3) said means for providing heat and mass transfer is adapted to be connected to said third dividing means to receive said second reflux stream as a top feed thereto.

34. The apparatus according to claim 9, 10, 11, 12, 13, 14, 28, 29, 30, or 15 wherein said means for providing heat and mass transfer includes one or more passes for an external heating medium to supplement the heating supplied by said second portion for said stripping of said more volatile components from said distillation liquid stream.

35. The apparatus according to claim 31 wherein said means for providing heat and mass transfer includes one or more passes for an external heating medium to supplement the heating supplied by said second portion for said stripping of said more volatile components from said distillation liquid stream.

36. The apparatus according to claim 32 wherein said means for providing heat and mass transfer includes one or more passes for an external heating medium to supplement the heating supplied by said second portion for said stripping of said more volatile components from said distillation liquid stream.

37. The apparatus according to claim 33 wherein said means for providing heat and mass transfer includes one or more passes for an external heating medium to supplement the heating supplied by said second portion for said stripping of said more volatile components from said distillation liquid stream.

* * * * *